US008010034B2

(12) United States Patent
Ozawa

(10) Patent No.: US 8,010,034 B2
(45) Date of Patent: Aug. 30, 2011

(54) WASTE TONER CONVEYING DEVICE AND IMAGE FORMING APPARATUS

(75) Inventor: Yoshinori Ozawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 350 days.

(21) Appl. No.: 12/382,280

(22) Filed: Mar. 12, 2009

(65) Prior Publication Data

US 2009/0232570 A1 Sep. 17, 2009

(30) Foreign Application Priority Data

Mar. 13, 2008 (JP) ..... 2008-063788
Jun. 5, 2008 (JP) ..... 2008-148100

(51) Int. Cl.
*G03G 21/00* (2006.01)
*G03G 21/12* (2006.01)

(52) U.S. Cl. ..... 399/358; 399/360

(58) Field of Classification Search ..... 399/358, 399/360, 101, 343, 349
See application file for complete search history.

(56) References Cited

U.S. PATENT DOCUMENTS 5,933,690 A * 8/1999 Sugimoto et al. ..... 399/358
7,103,308 B2 * 9/2006 Wakana ..... 399/358
7,881,642 B2 * 2/2011 Walsh et al. ..... 399/360

FOREIGN PATENT DOCUMENTS

JP 8-328337 12/1996
JP 9-90703 4/1997
JP 2000-231316 8/2000

* cited by examiner

*Primary Examiner* — Susan S Lee
(74) *Attorney, Agent, or Firm* — Harness, Dickey & Pierce, P.L.C.

(57) ABSTRACT

A waste toner conveying device includes a first conveying path configured to convey waste toner having paper powder at a low mixed ratio, which is stored in a first cleaning device, outside the first cleaning device, a second conveying path configured to convey second waste toner having a paper powder at a high mixed ration, which is stored in a second cleaning device, outside the second cleaning device, and at least one forwarding path configured to convey the first waste toner conveyed from the first cleaning device through the first conveying path and the second waste toner conveyed from the second cleaning device through the second conveying path are conveyed to a waste toner storage device. The at least one forwarding path is configured to convey the first waste toner conveyed from the first cleaning device through the first conveying path to the waste toner storage device via the second conveying path.

19 Claims, 15 Drawing Sheets

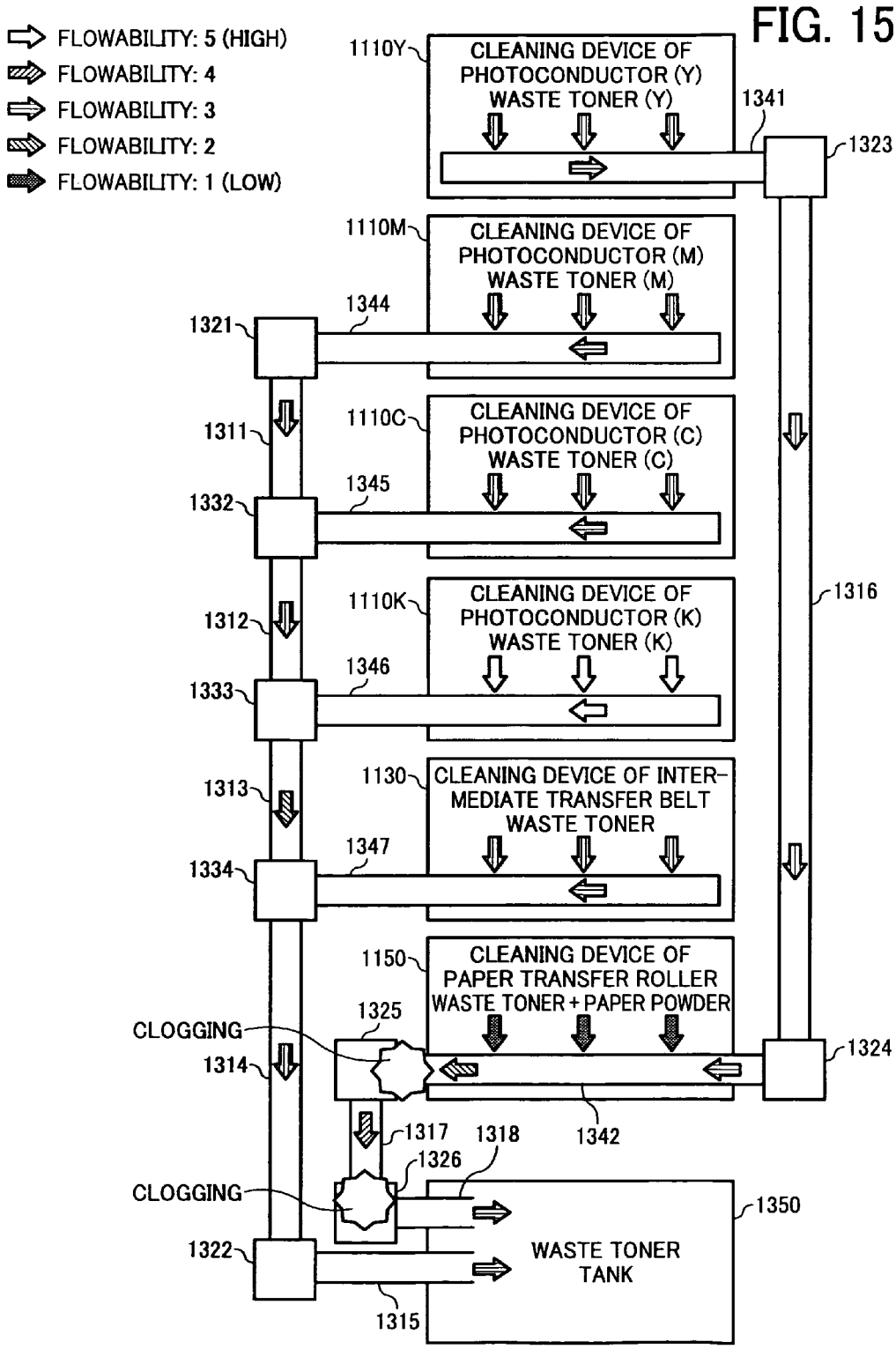
FIG. 15
FLOWABILITY: 5 (HIGH)
FLOWABILITY: 4
FLOWABILITY: 3
FLOWABILITY: 2
FLOWABILITY: 1 (LOW)
1110Y
CLEANING DEVICE OF PHOTOCONDUCTOR (Y) WASTE TONER (Y)
1341
1323
1110M
CLEANING DEVICE OF PHOTOCONDUCTOR (M) WASTE TONER (M)
1344
1321
1311
1110C
CLEANING DEVICE OF PHOTOCONDUCTOR (C) WASTE TONER (C)
1345
1332
1312
1110K
CLEANING DEVICE OF PHOTOCONDUCTOR (K) WASTE TONER (K)
1346
1333
1316
1313
1130
CLEANING DEVICE OF INTER-MEDIATE TRANSFER BELT WASTE TONER
1347
1334
1150
CLEANING DEVICE OF PAPER TRANSFER ROLLER WASTE TONER + PAPER POWDER
1325
CLOGGING
1314
1324
1342
1317
1318
1326
CLOGGING
1350
1322
WASTE TONER TANK
1315

WASTE TONER CONVEYING DEVICE AND IMAGE FORMING APPARATUS

CROSS REFERENCE TO RELATED APPLICATIONS

The present application is based on and claims priority from Japanese Application Numbers 2008-063788, filed on Mar. 13, 2008, and 2008-148100, filed on Jun. 5, 2008, the disclosure of which is hereby incorporated by reference herein in its entirety.

BACKGROUND OF THE INVENTION

1. Field of the Invention

The present invention relates to a waste toner conveying device used in an image forming apparatus of electrophotographic system and an image forming apparatus.

2. Description of the Related Art

Generally, a color image forming apparatus has steps of forming toner images of four colors such as yellow (Y), magenta (M), cyan (C) and black (K) on one photoconductor or a plurality of photoconductors, overlapping the toner images on an intermediate transfer belt, transferring the overlapped toner images on a paper by a paper transfer roller and then fixing the transferred toner images. In such a color image forming apparatus, a cleaning device is provided on each of a photoconductor, an intermediate transfer belt, and a paper transfer roller (referred to as a photoconductor cleaning device, a paper-transfer cleaning device and an intermediate-transfer cleaning device, respectively) so as to remove remaining transferred toner images, toner images which are formed at a non-image area for adjusting image density, or the like. To the paper transfer roller and the intermediate transfer belt, paper powder is attached due to contact with a transfer paper when transferring. Therefore, paper powder is mixed in each of the waste toners in the paper-transfer and intermediate-transfer cleaning devices provided on the paper transfer roller and the intermediate transfer belt. Remaining transferred toner is continuously input on an image area of each of the photoconductor and intermediate-transfer cleaning devices provided on the photoconductor and the intermediate transfer belt. On the other hand, toner is not input on an image area of the paper transfer roller and only small amount of toner of toner images formed on a non-image area for adjusting image density is input. Accordingly, the paper-transfer cleaning device provided on the paper transfer roller has paper powder in waste toner at a mixed ratio higher than the other cleaning devices. That is, a relation of the paper powder mixed ratios between the cleaning devices is generally shown by the following relationship:

$$A>B\geqq C$$

where A is the mixed ratio of paper powder in the waste toner (referred to as paper-transfer waste toner) in the paper-transfer cleaning device provided on the paper transfer roller, B is the mixed ratio of paper powder in the waste toner (referred to as intermediate-transfer waste toner) in the intermediate-transfer cleaning device provided on the intermediate transfer belt, and C is the mixed ratio of paper powder in the waste toner (referred to as photoconductor waste toner) in the photoconductor cleaning device provided on the photoconductor.

In other words, the paper-transfer waste toner in the paper-transfer cleaning device has a high mixed ratio of paper powder, the photoconductor waste toner in the photoconductor cleaning device has a low mixed ratio of paper powder, and the intermediate-transfer waste toner in the intermediate-transfer cleaning device has a mixed ratio of paper powder, which is lower than the waste toner of the paper transfer roller and equal to or more than the waste toner of the photoconductor. When the paper powder is mixed in the waste toner, flowability of the waste toner is remarkably decreased. Accordingly, a relation of the flowabilities of the waste toners in the cleaning devices is shown by the following relationship:

$$A'<B'\leqq C'$$

where A' is the flowability of the waste toner in the paper-transfer cleaning device provided on the paper transfer roller, B' is the flowability of the waste toner in the intermediate-transfer cleaning device provided on the intermediate transfer belt, and C' is the flowability of the waste toner in the photoconductor cleaning device provided on the photoconductor.

Accordingly, the flowability of the waste toner of the paper transfer roller is low, the flowability of the waste toner of the photoconductor is high, and the flowability of the waste toner of the intermediate transfer roller is equal to or less than the waste toner of the photoconductor. The waste toners discharged from each cleaning device pass toner conveying paths provided in an image forming apparatus to convey the waste toners to a waste toner tank. The toner conveying paths are laid around components of image forming parts in the image forming apparatus. Accordingly, the toner conveying path is often connected to a delivery part outside of the cleaning device and bent at a substantially-right angle at the delivery part. At the delivery part where the toner conveying path is bent at the substantially-right angle, the waste toner is not smoothly flowed. Under difficult circumstances where a paper having large amount of paper powder is used, an image area is not small, that is, amount of the waste toner is also small and therefore a mixed ratio of paper powder in the waste toner is relatively increased, or temperature in the apparatus is increased due to continuous working of the image forming apparatus, the flowability of the waste toner which may have paper powder is decreased so that the toner is easily clogged at the delivery part. Configurations and operations of representative prior arts will be explained as follows.

FIG. 1 is an explanatory view illustrating a layout of an image forming part of a conventional image forming apparatus, which is used in an embodiment of the present invention. The image forming apparatus includes a photoconductor 1 as an image carrier, a charging device 2, an exposure device 3, a development device 4, a paper transfer roller 5, a resist roller 6, a fixing device 7, a photoconductor cleaning device 100 provided on the photoconductor 1, and a paper-transfer cleaning device 101 provided on the paper transfer roller 5. In the image forming apparatus having such a configuration, charging the photoconductor, exposing the charged photoconductor to form an electrostatic latent image, transferring the electrostatic latent image and cleaning waste toner are continuously performed at each parts as shown in FIG. 1 while the photoconductor 1 rotates, so that an image is formed on a transfer paper 8 fed from the resist roller 6 at an appropriate timing. The image formed on the transfer paper 8 is then fixed by the fixing device 7 and the transfer paper 8 on which the image is fixed is discharged from the image forming apparatus. In the photoconductor cleaning device 100, a waste toner conveying path 110 is provided and waste toner stored on the photoconductor 1 falls on the waste toner conveying path 110. The fallen waste toner is conveyed by rotating a not-illustrated conveying member such as a conveying coil, an auger, or the like, provided in the waste toner conveying path 110 in the photoconductor cleaning device 100 in a horizontal direction.

Similarly, in the paper-transfer cleaning device 101, a waste toner conveying path 112 is provided and waste toner stored on the paper transfer roller 5 falls on the waste toner conveying path 112. The fallen waste toner is conveyed by rotating a not-illustrated conveying member provided in the waste toner conveying path 112 in the paper-transfer cleaning device 101 in a direction perpendicular to a plane represented in FIG. 1. By both of the waste toner conveying paths, the waste toner is conveyed in a vertical direction to a delivery part configured to deliver the waste toner to a forwarding path or combined part where other conveying or forwarding path is combined. The detailed explanation of the waste toner conveying or forwarding paths will be described as follows.

In the above-mentioned configuration, in FIG. 1, only one set of the photoconductor 1 and the paper transfer roller 5, the photoconductor cleaning device 100 and the paper-transfer cleaning device 101 provided around the photoconductor 1 is shown. However, the image forming apparatus may have plural (four) sets thereof respectively corresponding to plural (four) colors such as Y, M, C, Bk as a color image forming apparatus and only one set may be shown by omitting other three sets of these configurations.

FIG. 9 is a schematic view illustrating flowabilities of waste toners and conveying directions for conveying the waste toner in waste toner conveying and forwarding paths in a conventional waste toner conveying device of the image forming apparatus (prior art 1). In FIG. 9, arrows indicate directions where the waste toner is conveyed and patterns in arrows indicate flowabilities of the waste toner, that is, a blanked arrow indicates high flowability, a mesh arrow indicates middle flowability, and filled arrow indicates low flowability (same in the following prior arts 2 to 7). In FIG. 9, reference numbers 210, 211, 212, 213, 214, and 215 indicate paths configured to convey the waste toner, and each path has a conveying member configured to rotate for flowing the waste toner in the directions indicated by the arrows. Reference numbers 220, 221, 222, and 223 indicate delivery parts configured to deliver the waste toner from one path to another path. The path of the waste toner is bent at a substantially-right angle at each delivery part.

Waste toner having relatively-high flowability is stored in the photoconductor cleaning device 100, and waste toner having relatively-low flowability, where paper powder is mixed, is stored in the paper-transfer cleaning device 101. The waste toners are configured to fall in the waste toner conveying paths 210, 212 provided in the cleaning devices 100, 101, respectively.

The waste toner having the relatively-high flowability stored in the photoconductor cleaning device 100 is conveyed from the conveying path 210 to a waste toner storage tank 102 via the delivery part 220, the forwarding path 211, the delivery part 221, and then the forwarding path 213. On the other hand, the waste toner having the relatively-low flowability stored in the paper-transfer cleaning device 101 is conveyed from the conveying path 212 to the waste toner tank 102 via the delivery part 222, the forwarding path 214, the delivery part 223, and then the forwarding path 215.

In such a waste toner conveying device, the delivery parts 220, 221 are not clogged with the waste toner even under the above-mentioned difficult circumstances. However, there is a problem in that the delivery parts 222, 223 may be clogged with the waste toner due to the low flowability of the waste toner passing through the delivery parts 222, 223 under the above-mentioned difficult circumstances.

FIG. 10 is a schematic view illustrating flowabilities of waste toners and conveying directions for conveying the waste toner in waste toner conveying and forwarding paths in another conventional waste toner conveying device of the image forming apparatus (prior art 2). In FIG. 10, reference numbers 310, 311, 312, 313 and 314 indicate paths configured to convey the waste toner, and each path has a conveying member configured to rotate for flowing the waste toner in the directions indicated by the arrows. Reference numbers 320 and 322 indicate delivery parts configured to deliver the waste toner from one path to another path. The path of the waste toner is bent at a substantially-right angle at each delivery part. Reference number 321 indicates a T-shaped combined part where two paths are combined in a T-shaped form, that is, one path is linear and another path is bent at a substantially-right angle.

Waste toner having relatively-high flowability is stored in the photoconductor cleaning device 100, and waste toner having relatively-low flowability, where paper powder is mixed, is stored in the paper-transfer cleaning device 101. The waste toners are configured to fall in the waste toner conveying paths 310, 312 provided in the cleaning devices 100, 101, respectively.

The waste toner having the relatively-high flowability stored in the photoconductor cleaning device 100 is conveyed from the conveying path 310 to a waste toner storage tank 102 via the delivery part 320, the forwarding path 311, the combined part 321, the forwarding path 313, the delivery part 322, and then the forwarding path 314. On the other hand, the waste toner having the relatively-low flowability stored in the paper-transfer cleaning device 101 is conveyed from the conveying path 312 to the waste toner tank 102 via the combined part 321, the forwarding path 313, the delivery part 322, and then the forwarding path 314.

In such a waste toner conveying device, the delivery parts 320, 322 are not clogged with the waste toner even under the above-mentioned difficult circumstances because the waste toner passing therethrough has at least middle flowability. However, there is a problem in that the combined part 321 may be clogged with the waste toner because the waste toner passing one of the two combined paths has flowability lower than that passing the other one of the two combined paths under the above-mentioned difficult circumstances.

FIG. 11 is a schematic view illustrating flowabilities of waste toners and conveying directions for conveying the waste toner in waste toner conveying and forwarding paths in another conventional waste toner conveying device of the image forming apparatus (prior art 3). In FIG. 10, reference numbers 410, 411, 412, 413 and 414 indicate paths configured to convey the waste toner, and each path has a conveying member configured to rotate for flowing the waste toner in the directions indicated by the arrows. Reference numbers 420 and 422 indicate delivery parts configured to deliver the waste toner from one path to another path. The path of the waste toner is bent at a substantially-right angle at each delivery part. Reference number 421 indicates a T-shaped combined part where two paths are combined in a T-shaped form, that is, one path is linear and another path is bent at a substantially-right angle.

Waste toner having relatively-low flowability, where paper powder is mixed, is stored in the paper-transfer cleaning device 101 and waste toner having relatively-high flowability is stored in the photoconductor cleaning device 100. The waste toners are configured to fall in the waste toner conveying paths 412, 410 provided in the cleaning devices 101, 100, respectively.

The waste toner having the relatively-low flowability stored in the paper-transfer cleaning device 101 is conveyed from the conveying path 412 to a waste toner storage tank 102 via the delivery part 420, the forwarding path 411, the combined part 421, the forwarding path 413, the delivery part 422, and then the forwarding path 414. On the other hand, the waste toner having the relatively-high flowability stored in the photoconductor cleaning device 100 is conveyed from the conveying path 410 to the waste toner tank 102 via the combined part 421, the forwarding path 413, the delivery part 422, and then the forwarding path 414.

In such a waste toner conveying device, the delivery part 422 is not clogged with the waste toner even under the above-mentioned difficult circumstances because the waste toner passing therethrough has at least middle flowability. However, there is a problem in that the delivery part 420 may be clogged with the waste toner because of low flowability under the above-mentioned difficult circumstances. Furthermore, there is a problem in that the combined part 421 may be clogged with the waste toner because the waste toner passing one of the two combined paths has flowability lower than that passing the other one of the two combined paths under the above-mentioned difficult circumstances In an image forming apparatus having a plurality of cleaning devices, a layout where a plurality of waste toner conveying paths are combined with the others to convey the waste toner to the waste toner tank is often used. In the combined part, when the waste toner having relatively-high flowability from one side and the waste toner having relatively-low flowablity from the other side flow to the combined part, the waste toner having high flowability tends to selectively flow and pass through the combined part. Therefore, under the above-mentioned difficult circumstances, the conveying path is easily clogged just before the combined part with the waste toner having low flowability. Accordingly, when the toner clogging occurs, the not-illustrated conveying member provided in the waste toner conveying path is locked and broken. Representative configurations, operations and the like of conventional examples will be explained as follows.

FIG. 3 is an explanatory view illustrating a layout of an image forming part of a conventional image forming apparatus, which is used in another embodiment of the present invention. The image forming apparatus includes a photoconductor 51 as an image carrier, a charging device 52, an exposure device 53, a development device 54, a first transfer roller 55, an intermediate transfer belt 56, a paper transfer roller 57, a resist roller 58, a fixing device 60, a photoconductor cleaning device 500 provided on the photoconductor 51, an intermediate-transfer cleaning device 501 provided on the intermediate transfer belt 56 and a paper-transfer cleaning device 502 provided on the paper transfer roller 57. In the image forming apparatus having such a configuration, charging the photoconductor, exposing the charged photoconductor to form an electrostatic latent image, transferring the electrostatic latent image and cleaning waste toner are continuously performed at each parts as shown in FIG. 3 while the photoconductor 51 and the intermediate transfer belt 56 rotate respectively, so that an image is formed on a transfer paper 61 fed from the resist roller 58 at an appropriate timing. The image formed on the transfer paper 61 is then fixed by the fixing device 60 and the transfer paper 61 on which the image is fixed is discharged from the image forming apparatus. The development device 54 is a so-called revolver-type development device where four development devices 54Bk, 54C, 54M, 54Y are disposed about an axis of rotation and rotated about the axis of rotation so as to develop toner images with the toners included in the development devices on the photoconductor 51.

In the photoconductor cleaning device 500, a waste toner conveying path 510 is provided and waste toner stored on the photoconductor 51 falls on the waste toner conveying path 510. The fallen waste toner is conveyed by rotating a not-illustrated conveying member provided in the waste toner conveying path 510 in the photoconductor cleaning device 500 in a horizontal direction.

Similarly, in the intermediate-transfer cleaning device 501, a waste toner conveying path 512 is provided and waste toner stored on the paper transfer roller 5 falls on the waste toner conveying path 512. The fallen waste toner is conveyed by rotating a not-illustrated conveying member provided in the waste toner conveying path 512 in a horizontal direction.

Furthermore, in the paper-transfer cleaning device 502, a waste toner conveying path 514 is provided and waste toner stored on the paper transfer roller 57 falls on the waste toner conveying path 514. The fallen waste toner is conveyed by rotating a not-illustrated conveying member provided in the waste toner conveying path 514 in a horizontal direction.

By each waste toner conveying path, the waste toner is conveyed in a direction perpendicular to a plane represented in FIG. 3 to a delivery part configured to deliver the waste toner to a forwarding path or combined part where other conveying or forwarding path is combined. The detailed explanation of the waste toner conveying or forwarding paths will be described as follows.

In the above-mentioned configuration, in FIG. 3, only one set of the photoconductor 51 and the charging device, the photoconductor cleaning device and the like around the photoconductor 51 is shown. However, the image forming apparatus may have plural (four) sets thereof respectively corresponding to plural (four) colors such as Y, M, C, Bk as a color image forming apparatus and only one set may be shown by omitting other three sets of these configurations In FIG. 3, reference number 59 indicates a feeding belt of the transfer paper 61.

FIG. 12 is a schematic view illustrating flowabilities of waste toners and conveying directions for conveying the waste toner in waste toner conveying and forwarding paths in a conventional waste toner conveying device of the image forming apparatus (prior art 4). In FIG. 12, arrows indicate directions where the waste toner is conveyed and patterns in arrows indicate flowabilities of the waste toner. In FIG. 12, reference numbers 810, 811, 812, 813, 814, 815, 816 and 817 indicate paths configured to convey the waste toner, and each path has a conveying member configured to rotate for flowing the waste toner in the directions indicated by the arrows. Reference numbers 820, 822, 823, and 824 indicate delivery parts configured to deliver the waste toner from one path to another path. The path of the waste toner is bent at a substantially-right angle at each delivery part. In addition, reference number 821 indicates a T-shaped combined part where two paths are combined in a T-shaped form, that is, one path is linear and another path is bent at a substantially-right angle.

Waste toners having relatively-high flowability are stored in the photoconductor cleaning device 500 and the intermediate-transfer cleaning device 501, respectively. On the other hand, waste toner having relatively-low flowability, where paper powder is mixed, is stored in the paper-transfer cleaning device 502. The waste toners are configured to fall in the waste toner conveying paths 810, 812 and 814 provided in the cleaning devices, respectively.

The waste toner having the relatively-high flowability stored in the photoconductor cleaning device 500 passes through the conveying path 810, turns at a substantially-right angle at the delivery part 820, passes through the forwarding path 811 and then is conveyed to the combined part 821. The waste toner having the relatively-high flowability (slightly less than that stored in the photoconductor cleaning device but relatively-high in the waste toner conveying device of the prior art 4) stored in the intermediate-transfer cleaning device 501 passes through the conveying path 812, turns at a substantially-right angle at the delivery part 821, and then passes through the forwarding path 813 while flowing together with the waste toner discharged from the photoconductor cleaning device 500. At this time, flowability of the mixed waste toners in the forwarding path 813 is maintained high. Then, the mixed waste toners pass through the delivery part 822 and the forwarding path 817, and are finally conveyed to the waste toner tank 503 and stored. On the other hand, the waste toner having relatively-low flowability stored in the paper-transfer cleaning device 502 passes through the conveying path 814, turns at a substantially-right angle at the delivery part 823, and then passes through the forwarding path 815, the delivery part 824 and the forwarding path 816 and is conveyed to the waste toner tank 503.

In such a waste toner conveying device, the delivery parts 820, 822 are not clogged with the waste toner even under the above-mentioned difficult circumstances because of at least middle flowability of the waste toner. The combined part 821 is not clogged with the waste toner even under the above-mentioned difficult circumstances because of high flowability of each of the two conveyed waste toners. However, there is a problem in that the delivery parts 823, 824 may be clogged with the waste toner due to the low flowability of the waste toner passing through the delivery parts 823, 824 under the above-mentioned difficult circumstances.

FIG. 13 is a schematic view illustrating flowabilities of waste toners and conveying directions for conveying the waste toner in waste toner conveying and forwarding paths in a conventional waste toner conveying device of the image forming apparatus (prior art 5). In FIG. 13, reference numbers 910, 911, 912, 913, 914, 915 and 916 indicate paths configured to convey the waste toner, and each path has a conveying member configured to rotate for flowing the waste toner in the directions indicated by the arrows. Reference numbers 920 and 923 indicate delivery parts configured to deliver the waste toner from one path to another path. The path of the waste toner is bent at a substantially-right angle at each delivery part. In addition, each of reference numbers 921, 922 indicates a T-shaped combined part where two paths are combined in a T-shaped form, that is, one path is linear and another path is bent at a substantially-right angle.

Waste toners having relatively-high flowability are stored in the photoconductor cleaning device 500 and the intermediate-transfer cleaning device 501, respectively. On the other hand, waste toner having relatively-low flowability, where paper powder is mixed, is stored in the paper-transfer cleaning device 502. The waste toners are configured to fall in the waste toner conveying paths 910, 912 and 914 provided in the cleaning devices 500, 501 and 502, respectively.

The waste toner having the relatively-high flowability stored in the photoconductor cleaning device 500 passes through the conveying path 910, turns at a substantially-right angle at the delivery part 920, passes through the forwarding path 911 and then is conveyed to the combined part 921. The waste toner having the relatively-high flowability (slightly less than that stored in the photoconductor cleaning device but relatively-high in the waste toner conveying device of the prior art 5) stored in the intermediate-transfer cleaning device 501 passes through the conveying path 912, turns at a substantially-right angle at the delivery part 921, and then passes through the forwarding path 913 while flowing together with the waste toner discharged from the photoconductor cleaning device 500. At this time, flowability of the mixed waste toners in the forwarding path 913 is maintained high. Then, the mixed waste toner is conveyed to the delivery part 922. On the other hand, the waste toner having relatively-low flowability stored in the paper-transfer cleaning device 502 passes through the conveying path 914, turns at a substantially-right angle at the delivery part 922, and then passes through the forwarding path 915, the delivery part 923 and the forwarding path 916 while flowing together with the waste toners discharged from the cleaning devices 500, 501, and is conveyed to the waste toner tank 503.

In such a waste toner conveying device, the delivery parts 920, 923 are not clogged with the waste toner even under the above-mentioned difficult circumstances because of at least middle flowability of the waste toner. The combined part 921 is not clogged with the waste toner even under the above-mentioned difficult circumstances because of high flowability of each of the two conveyed waste toners. However, there is a problem in that the delivery part 922 may be clogged with the waste toner due to the low flowability of one of the waste toners from two sides under the above-mentioned difficult circumstances.

In Japanese Patent Number 3308138, as one of the most close prior art (prior art 6), as shown in FIG. 14, waste toner discharged from an intermediate-transfer cleaning device 501 is conveyed to a conveying path 1010 of a photoconductor cleaning device 500 of a photoconductor via paths 1012, 1011. Reference numbers 1013, 1014 indicate forwarding paths each configured to convey the waste toner from the conveying path 1010 in the photoconductor cleaning device 500 to a waste toner tank 503. Reference numbers 1022, 1023 indicate delivery parts. In Japanese Patent Number 3308138, in order to improve user operability, the waste toner tank is appropriately exchanged while dispensing with needlessness, such as discarding an empty waste toner tank. Although this object is not same as that of the present invention, the configuration, where waste toner discharged from one cleaning device passes through a conveying path in another cleaning device, is similar to that of the present invention. However, in this configuration of the prior art 6, the waste toner having relatively-low flowability discharged from the intermediate-transfer cleaning device passes delivery parts 1021, 1020 which is bent at a substantially-right angle and then is conveyed to the photoconductor cleaning device where the waste toner having relatively-high flowability is stored. The waste toner of the intermediate transfer belt has more paper powder than the waste toner of the photoconductor and therefore the flowability of the waste toner of the intermediate transfer belt is relatively low. Accordingly, it cannot be expected that the two delivery parts 1021, 1020 is prevented from being clogged with the waste toner of the intermediate transfer belt.

FIG. 7 is an explanatory view illustrating a layout of an image forming part of another conventional image forming apparatus, which is used in another embodiment of the present invention. The image forming apparatus includes photoconductors 71Y, 71M, 71C, 71K as image carriers, charging devices 72Y, 72M, 72C, 72K, exposure devices 73Y, 73M, 73C, 73K, development devices 74Y, 74M, 74C, 74K, first transfer rollers 76, 77, 78, 79, an intermediate transfer belt 80, photoconductor cleaning devices 1110Y, 1110M, 1110C, 1110K of the photoconductors 71Y, 71M, 71C, 71K, an intermediate-transfer cleaning device 1130 of the intermediate transfer belt 80, a paper transfer roller 83, a paper-transfer cleaning device 1150 of the paper transfer roller 83, a resist roller 85, a paper feeding belt 86, a fixing device 87, and the like. In the image forming apparatus having such a configuration, charging the photoconductors, exposing the charged photoconductors to form electrostatic latent images, transferring the electrostatic latent images as a primary transfer and cleaning waste toner of the photoconductors are continuously performed at each parts as shown in FIG. 7 while the photoconductors 71Y to 71K and the intermediate transfer belt 80 rotate respectively, so that toner images are formed on the intermediate transfer belt 80 which rotates at a speed substantially equal to that of the photoconductors. The toner images formed on the intermediate transfer belt 80 are then transferred at a time by the paper transfer roller 83 on a paper 90 which is fed by the resist roller 85. Then, the paper where the toner images are transferred is fed by the paper feeding belt 86 and the toner images are fixed by the fixing device 87 on the paper and then, the paper is discharged from the image forming apparatus. In the photoconductor cleaning devices 1110Y to 1110K, waste toner conveying paths 1120Y to 1120K are provided and waste toner stored on each of the photoconductors falls on each waste toner conveying paths 1120Y to 1120K, respectively. The fallen waste toners are conveyed by rotating not-illustrated conveying members such as conveying coils, augers, or the like, provided in the waste toner conveying paths 1120Y to 1120K in the photoconductor cleaning devices 1110Y to 1110K in a direction perpendicular to a plane represented in FIG. 7. In the intermediate-transfer cleaning device 1130, a waste toner conveying path 1140 is provided and waste toner stored on the photoconductors falls on the waste toner conveying path 1140. The fallen waste toner is conveyed by rotating a not-illustrated conveying member such as a conveying coil or an auger provided in the waste toner conveying path 1140 in the intermediate-transfer cleaning device 1130 in a direction perpendicular to a plane represented in FIG. 7. In the paper-transfer cleaning device 1150, a waste toner conveying path 1160 is provided and waste toner stored on the paper transfer roller 83 falls on the waste toner conveying path 1160. The fallen waste toner is conveyed by rotating a not-illustrated conveying member provided in the waste toner conveying path 1160 in the paper-transfer cleaning device 1150 in a direction perpendicular to a plane represented in FIG. 7.

FIG. 15 is a schematic view illustrating flowabilities of waste toners and conveying directions for conveying the waste toner in waste toner conveying and forwarding paths in the conventional waste toner conveying device of the image forming apparatus (prior art 7). In FIG. 15, arrows indicate the conveying direction of the waste toners and patterns (mesh) of the arrows indicate flowabilities of the waste toners in five levels. Reference numbers 1311, 1312, 1313, 1314, 1315, 1316, 1317, 1318, 1344, 1345, 1346, 1347, 1341, and 1342 indicate paths configured to convey the waste toner, and each path has a conveying member such as a conveying coil or an auger configured to rotate for flowing the waste toner in the directions indicated by the arrows. Reference numbers 1321, 1322, 1323, 1324, 1325, and 1326 indicate delivery parts configured to deliver the waste toner from one path to another path. The path of the waste toner is bent at a substantially-right angle at each delivery part. In addition, each of reference numbers 1332, 1333 and 1334 indicates a T-shaped combined part where two paths are combined in a T-shaped form, that is, one path is linear and another path is bent at a substantially-right angle.

Waste toner having relatively-high flowability (level 5) is stored in the photoconductor cleaning device 1110K, waste toner having relatively-middle flowability (level 3) is stored in each of the photoconductor cleaning devices 1110Y to 1110C and the intermediate-transfer cleaning device 1130, and waste toner having relatively-low flowability (level 1) is stored in the paper-transfer cleaning device 1150.

The waste toner having middle flowability (level 3) stored in the photoconductor cleaning device 1110Y passes the conveying path 1341, the delivery part 1323, the forwarding path 1316 and the delivery path 1324 and then is conveyed to the conveying path 1342 in the paper-transfer cleaning device 1150. In the conveying path 1342, the waste toner conveyed from the photoconductor cleaning device 1110Y is mixed with the waste toner having relatively-low flowability (level 1) conveyed from the paper-transfer cleaning device 1150 and then the mixed waste toners having flowability of level 4 is obtained at the delivery part 1325. The mixed waste toners pass the delivery part 1325, are conveyed to the waste toner tank 1350 via the forwarding path 1317, the delivery part 1326, the forwarding path 1318 and then stored in the waste toner tank 1350.

The waste toners stored in the photoconductor cleaning devices 1110M, 1110C, 1110K and the intermediate-transfer cleaning devices 1130 respectively, pass through the paths 1344, 1345, 1346, and 1347 via the delivery parts 1321, 1322 and the combined parts 1332, 1333, and 1334 shown in FIG. 15, and are conveyed to the waste toner tank 1350.

In such a waste toner conveying device of the prior art 7, the delivery parts 1321, 1322, 1323, 1324 and the combined parts 1332, 1333, 1334 are not clogged with the waste toners even under difficult circumstances where it works continuously at a high temperature because of at least middle flowability (level 3) of the waste toners. However, there is a problem in that the delivery part 1325, 1326 may be clogged with the waste toner due to less than middle flowability (level 2 or less) of the waste toner passing through the delivery part 1325, 1326 when the device works continuously at a high temperature.

SUMMARY OF THE INVENTION

An object of the present invention is to provide a waste toner conveying device and an image forming apparatus where waste toner having high flowability discharged from a conveying path of one cleaning device is flowed into a conveying path of another cleaning device where waste toner having low flowability is stored so that delivery parts and combined parts connected to the conveying paths, each of which are bent at a substantially-right angle, are prevented from being clogged with the waste toner.

To achieve the above object, a waste toner conveying device, includes a first conveying path configured to convey waste toner having paper powder at a low mixed ratio, which is stored in a first cleaning device, outside the first cleaning device, a second conveying path configured to convey second waste toner having a paper powder at a high mixed ration, which is stored in a second cleaning device, outside the second cleaning device, and at least one forwarding path configured to convey the first waste toner conveyed from the first cleaning device through the first conveying path and the second waste toner conveyed from the second cleaning device through the second conveying path are conveyed to a waste toner storage device. The at least one forwarding path is configured to convey the first waste toner conveyed from the first cleaning device through the first conveying path to the waste toner storage device via the second conveying path.

BRIEF DESCRIPTION OF THE DRAWINGS

FIG. 15 is a schematic view illustrating flowabilities of waste toners and conveying directions for conveying the waste toner in waste toner conveying paths in a waste toner conveying device according to a seventh conventional example of the present invention.

DETAILED DESCRIPTION OF THE PREFERRED EMBODIMENTS

Preferred embodiments of a waste toner conveying device and image forming apparatus according to the present invention will be explained in detail with reference to the accompanying drawings below.

Figure 1:
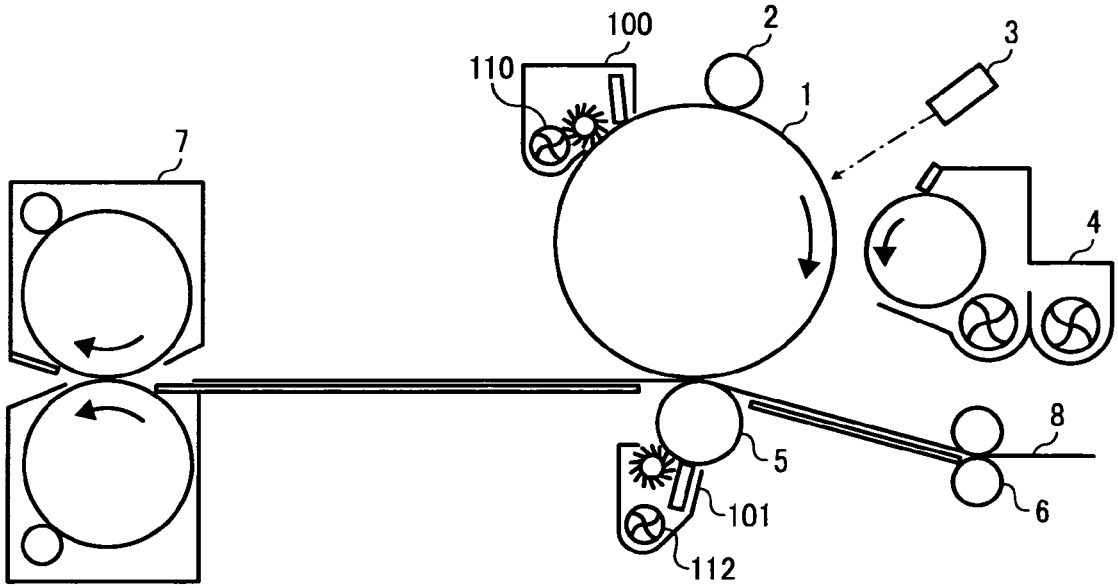
FIG. 1 is an explanatory view illustrating a layout of an image forming part of an image forming apparatus according to an embodiment of the present invention.

FIG. 1 is an explanatory view illustrating a layout of an image forming part of a first embodiment of the present invention. The configurations are explained hereinbefore and therefore the same reference numbers are used for the same configurations and explanation thereof is omitted.

Figure 2:
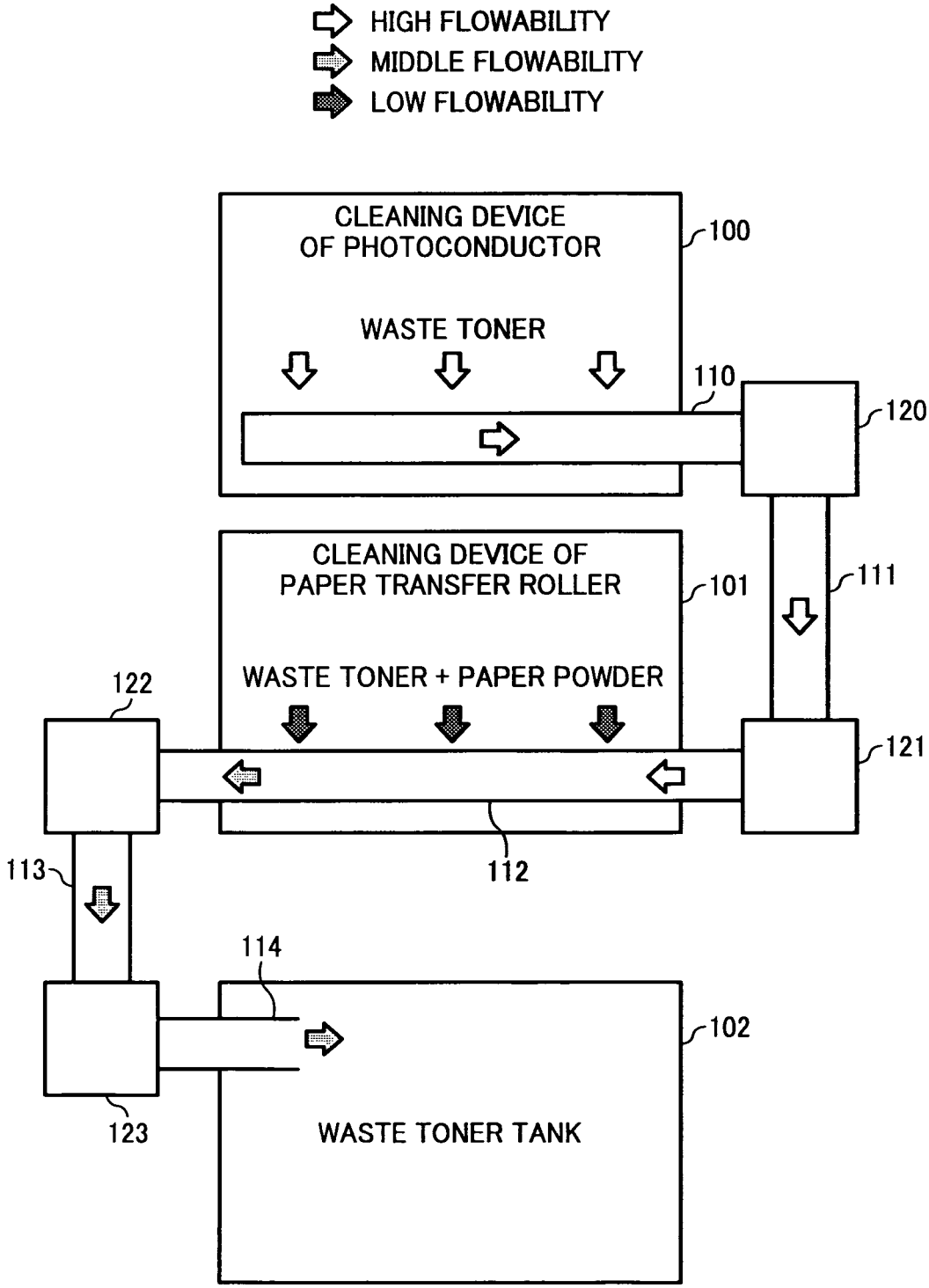
FIG. 2 is a schematic view illustrating flowabilities of waste toners and conveying directions for conveying the waste toner in waste toner conveying paths in a waste toner conveying device according to a first embodiment of the present invention.

FIG. 2 is a schematic view illustrating flowabilities of waste toners and conveying directions for conveying the waste toner in waste toner conveying and forwarding paths in the waste toner conveying device according to the first embodiment. In FIG. 2, arrows indicate directions where the waste toner is conveyed and patterns in arrows indicate flowabilities of the waste toner, that is, a blanked arrow indicates high flowability, a mesh arrow indicates middle flowability, and filled arrow indicates low flowability. In FIG. 2, reference numbers 110, 111, 112, 113 and 114 indicate paths configured to convey the waste toner, and each path may have a conveying member configured to rotate for flowing the waste toner in the directions indicated by the arrows. Reference numbers 120, 121, 122, and 123 indicate delivery parts configured to deliver the waste toner from one path to another path. The path of the waste toner is bent at a substantially-right angle at each delivery part. The waste toner conveying device according to this embodiment of the present invention includes a first conveying path 110 configured to convey first waste toner having paper powder at a low mixed ratio, which is stored in a first cleaning device 100 such as a photoconductor cleaning device provided on a photoconductor 1, outside the photoconductor cleaning device 100, a second conveying path 112 configured to convey second waste toner having a paper powder at a high mixed ration, which is stored in a second cleaning device 101 such as a paper-transfer cleaning device provided on a paper transfer roller 5, outside the paper-transfer cleaning device 101, and at least one forwarding path 111 configured to convey the first waste toner (photoconductor waste toner, hereinbelow) conveyed from the photoconductor cleaning device 100 through the first conveying path 110 and the second waste toner (paper-transfer waste toner) conveyed from the paper-transfer cleaning device 101 through the second conveying path 112 are conveyed to a waste toner storage device 102 such as a waste toner storage tank. The at least one forwarding path 111 is configured to convey the first waste toner conveyed from the photoconductor cleaning device 100 through the first conveying path 110 to the waste toner storage device 102 via the second conveying path 112.

The at least one forwarding path may include a first forwarding path 111 configured to convey the first waste toner conveyed from the first cleaning device 100 through the first conveying path 110 to the second conveying path 112 and a second forwarding path 113, 114 configured to convey the first and second waste toner conveyed from the second cleaning device 101 through the second conveying path 112 to the waste toner storage device 102.

In the photoconductor cleaning device 100, the photoconductor waste toner having relatively-high flowability is stored and in the paper-transfer cleaning device 101, the paper-transfer waste toner having relatively-low flowability, which is mixed with paper powder, is stored. The photoconductor and paper-transfer waste toners fall into the first and second conveying paths 110, 112, respectively.

The photoconductor waste toner having relatively-high flowability stored in the photoconductor cleaning device 100 is conveyed to the conveying path 110, the delivery part 120, the forwarding path 111, the delivery part 121, and then the conveying path 112 in the paper-transfer cleaning device 101. In the conveying path 112, the photoconductor waste toner is mixed with the paper-transfer waste toner having relatively-low flowability removed from the paper transfer roller 5 and therefore the mixed waste toner has middle flowability when it achieves the delivery part 122. The mixed waste toner is conveyed to the waste toner tank 102 via the delivery part 122, the forwarding path 113, the delivery part 123, and the forwarding path 114 and then stored in the waste toner tank 102.

In the waste toner conveying device, the delivery parts 120, 121, 122, 123 are not clogged with the waste toner because the waste toner passing through the delivery parts 120, 121, 122, 123 has at least middle flowability even under the above-mentioned difficult condition.

(Comparison Between the First Embodiment and Prior Arts 1 to 3)

Figure 9:
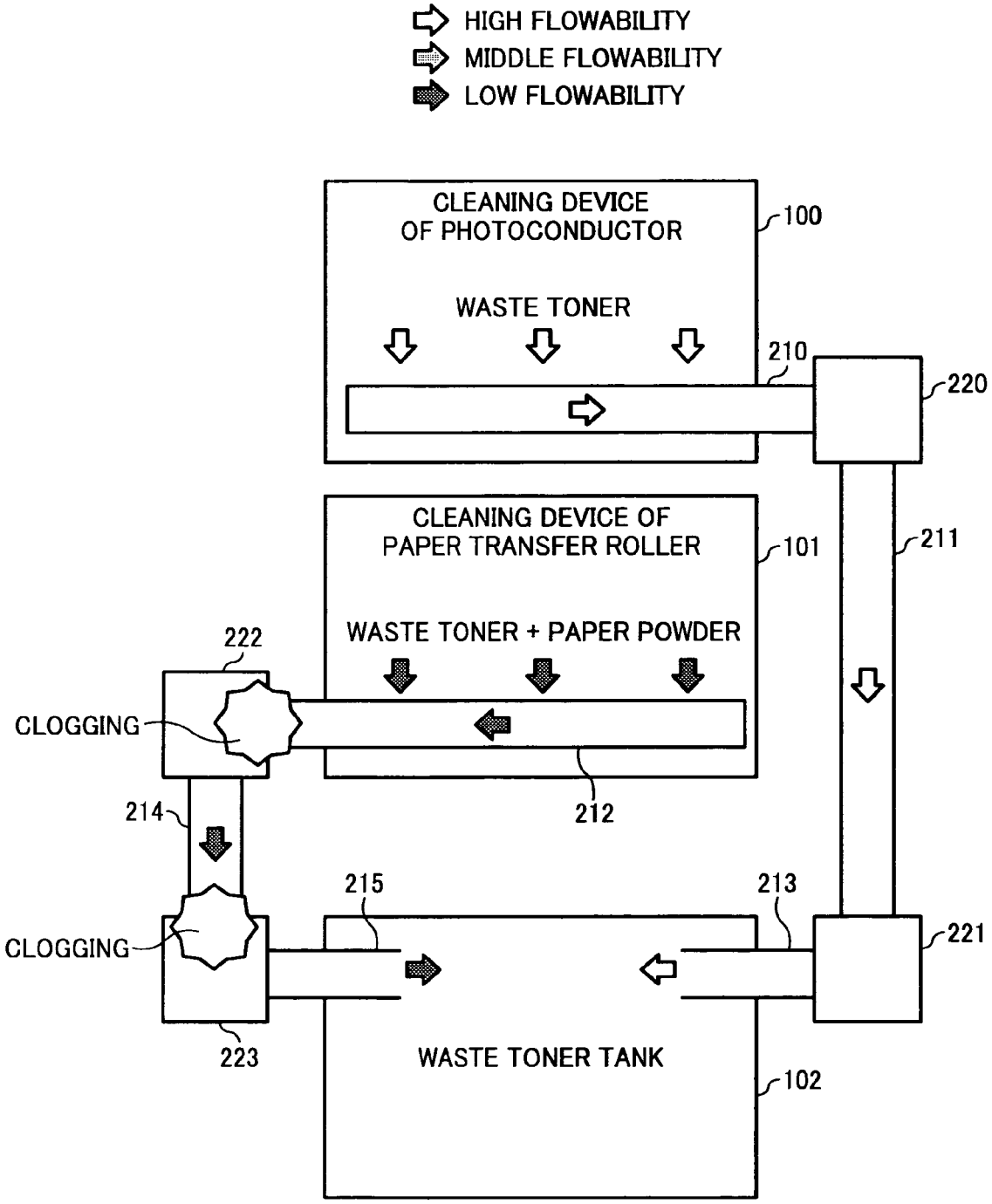
FIG. 9 is a schematic view illustrating flowabilities of waste toners and conveying directions for conveying the waste toner in waste toner conveying paths in a waste toner conveying device according to a first conventional example of the present invention.
Figure 10:
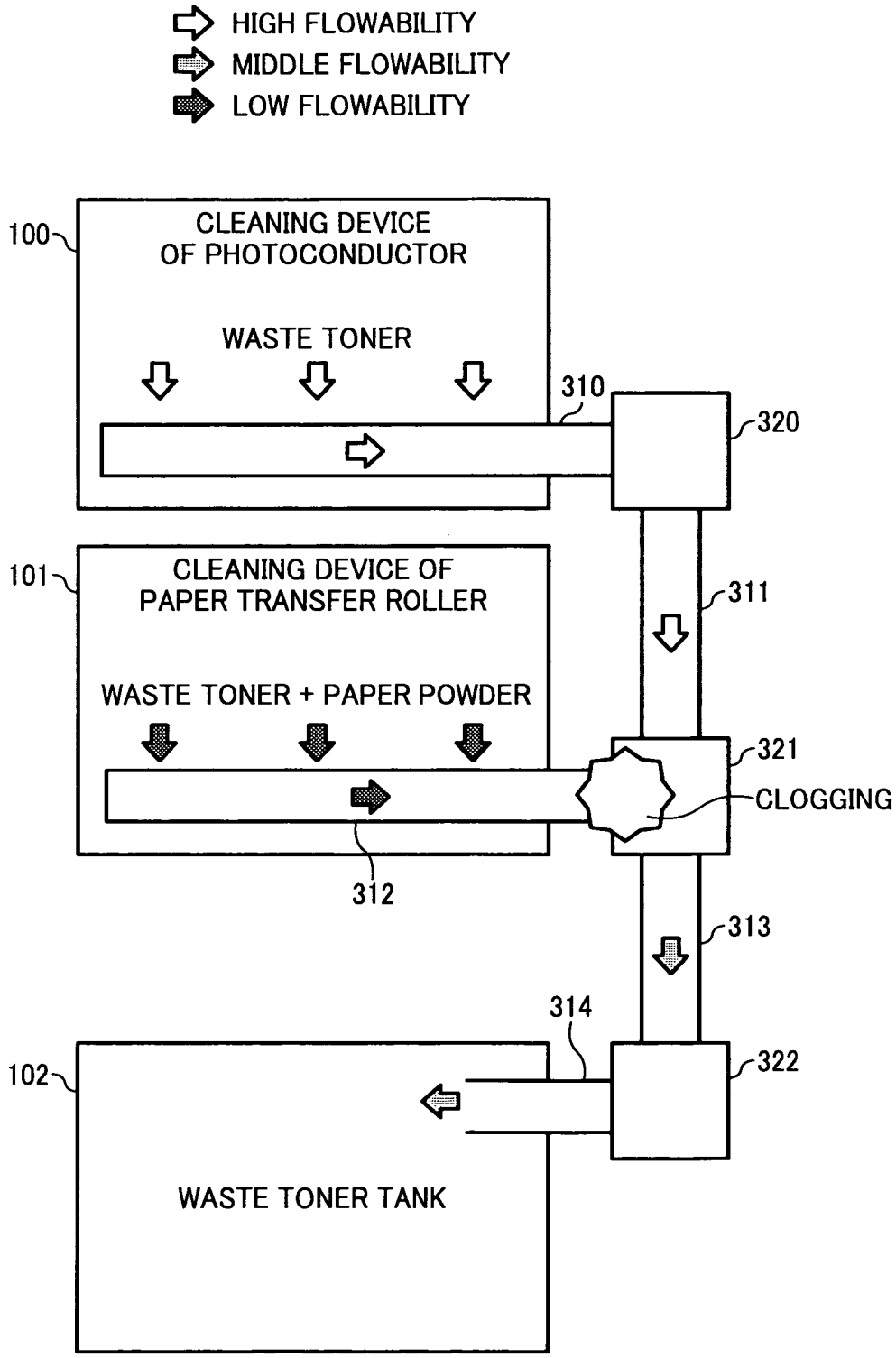
FIG. 10 is a schematic view illustrating flowabilities of waste toners and conveying directions for conveying the waste toner in waste toner conveying paths in a waste toner conveying device according to a second conventional example of the present invention.
Figure 11:
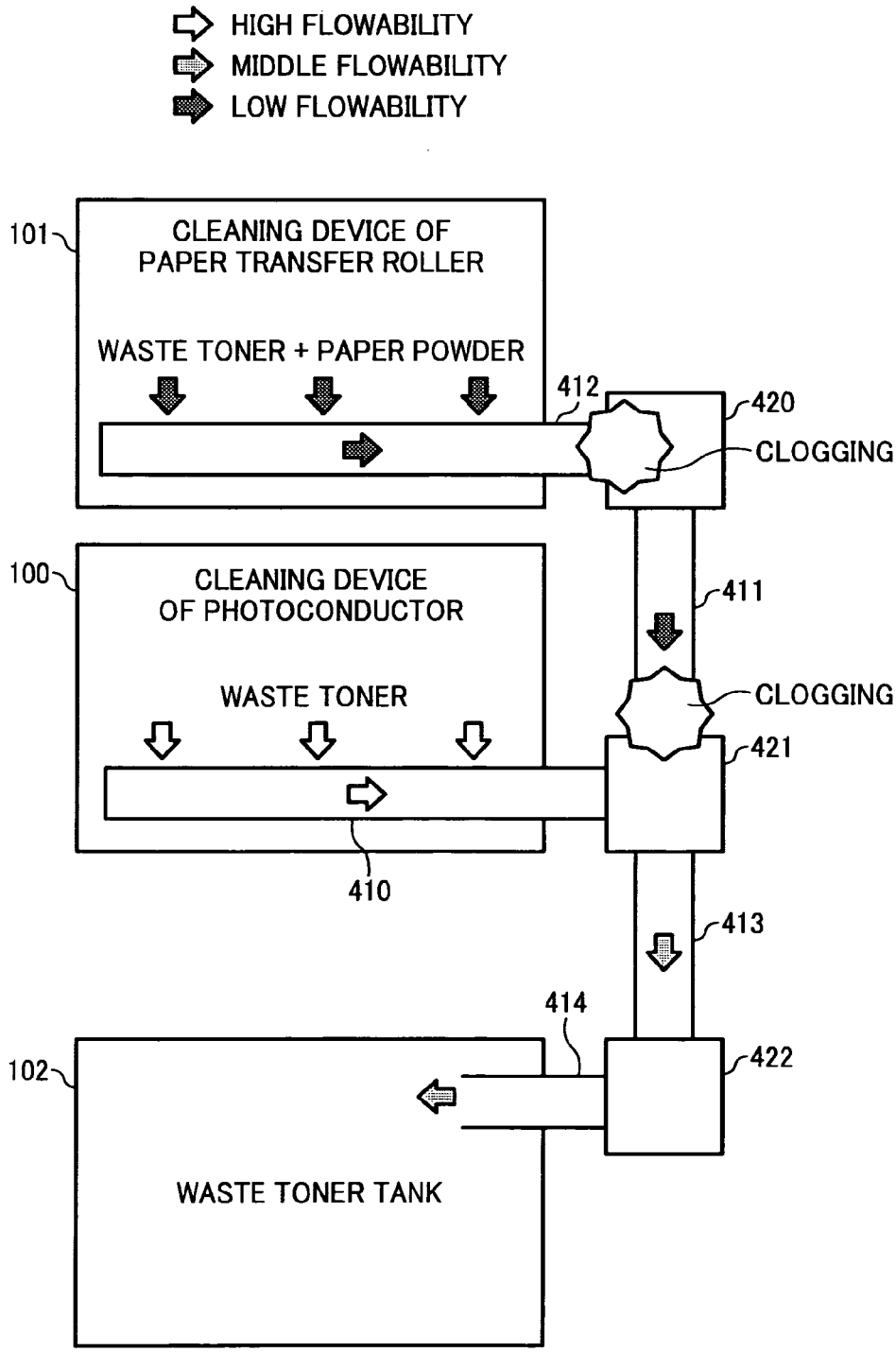
FIG. 11 is a schematic view illustrating flowabilities of waste toners and conveying directions for conveying the waste toner in waste toner conveying paths in a waste toner conveying device according to a third conventional example of the present invention.

The delivery parts 222, 223 in the prior art 1 (see FIG. 9), the combined part 321 in the prior art 2 (see FIG. 10), and the delivery parts 420, 421 in prior art 3 (see FIG. 11) are easily clogged under the above-mentioned difficult circumstances, because the waste toner having relatively-low flowability passes and flows together with each other. On the other hand, in the first embodiment of the present invention, the waste toner having relatively low flowability is mixed with the waste toner having relatively high flowability before it passing through the delivery part 122 or 123 (see FIG. 2) so that the waste toner has middle flowability and therefore the delivery parts 122, 123 are not clogged with the waste toner passing therethrough. Consequently, the waste toner conveying device of the first embodiment of the present invention has an advantageous configuration where the waste toner clogging can be more effectively prevented than the prior arts 1 to 3.

The waste toner conveying device according an embodiment of the present invention may further include a third conveying path 512 (612) configured to convey third waste toner such as an intermediate-transfer waste toner having paper powder at a mixed ratio which is equal to or more than the photoconductor waste toner and less than the paper-transfer waste toner, which is stored in a third cleaning device 501 such as an intermediate-transfer cleaning device, outside the third cleaning device. The third waste toner conveyed from the third cleaning device 501 through the third conveying path 512 (612) may be conveyed through the forwarding path 513 (613) to the waste toner storage device 503. The at least one forwarding path 515 may flow the third waste toner conveyed from the third cleaning device 501 through the third conveying path 512 into the first and second waste toners conveyed via the second conveying path 514. The at least one forwarding path may include a first forwarding path 511 configured to convey the first waste toner conveyed from the first cleaning device 500 through the first conveying path 510 to the second conveying path 514, a second forwarding path 515 configured to convey the second waste toner conveyed from the second cleaning device 502 through the second conveying path 514 to the waste toner storage device 503, and a third forwarding path 513 configured to convey the third waste toner conveyed from the third cleaning device 501 through the third conveying path 512 to the second forwarding path 515.

Figure 3:
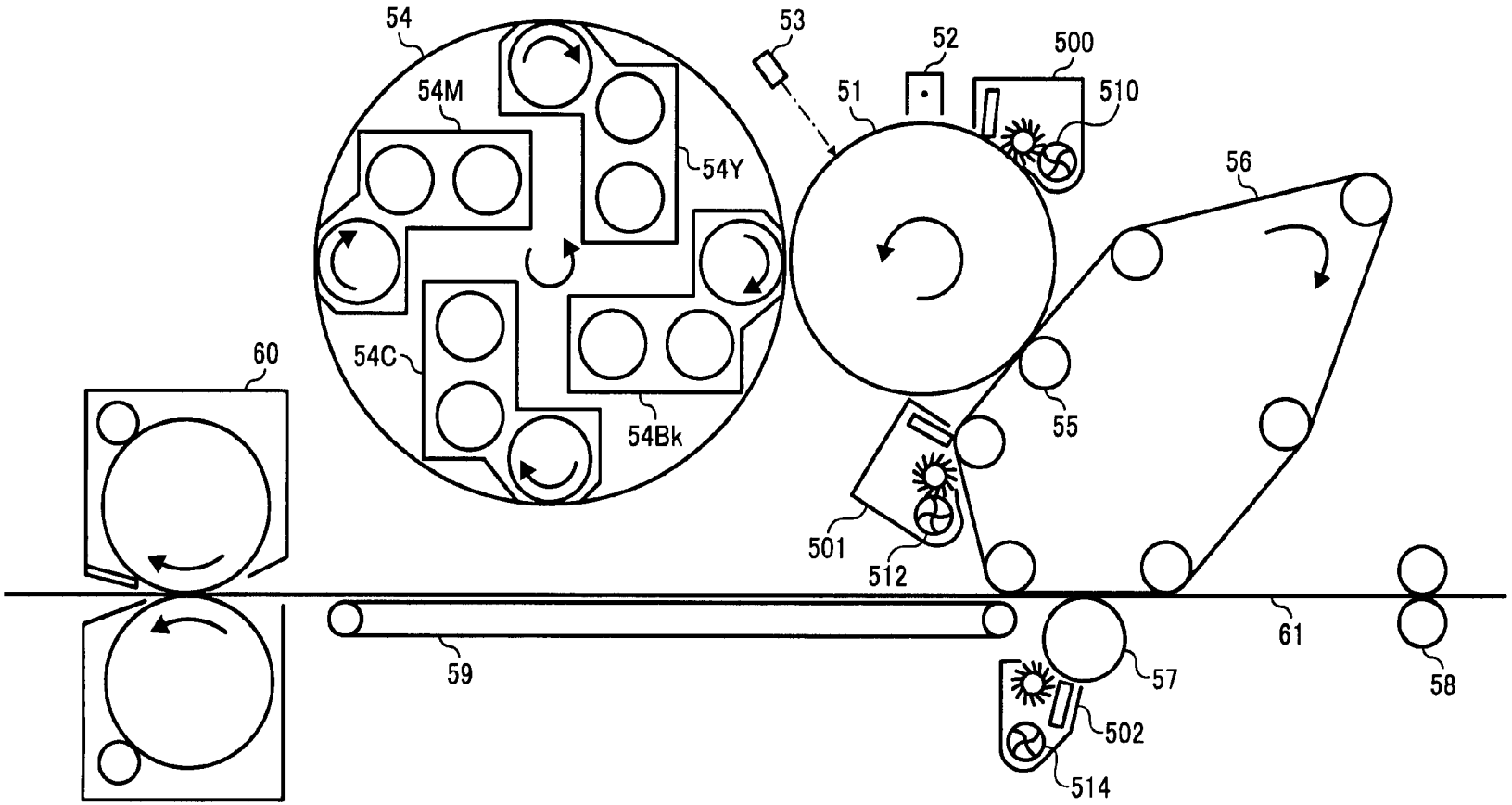
FIG. 3 is an explanatory view illustrating a layout of an image forming part of an image forming apparatus according to another embodiment of the present invention.

FIG. 3 is an explanatory view illustrating a layout of an image forming part of another embodiment of the present invention. The configurations are explained hereinbefore and therefore the same reference numbers are used for the same configurations and explanation thereof is omitted.

Figure 4:
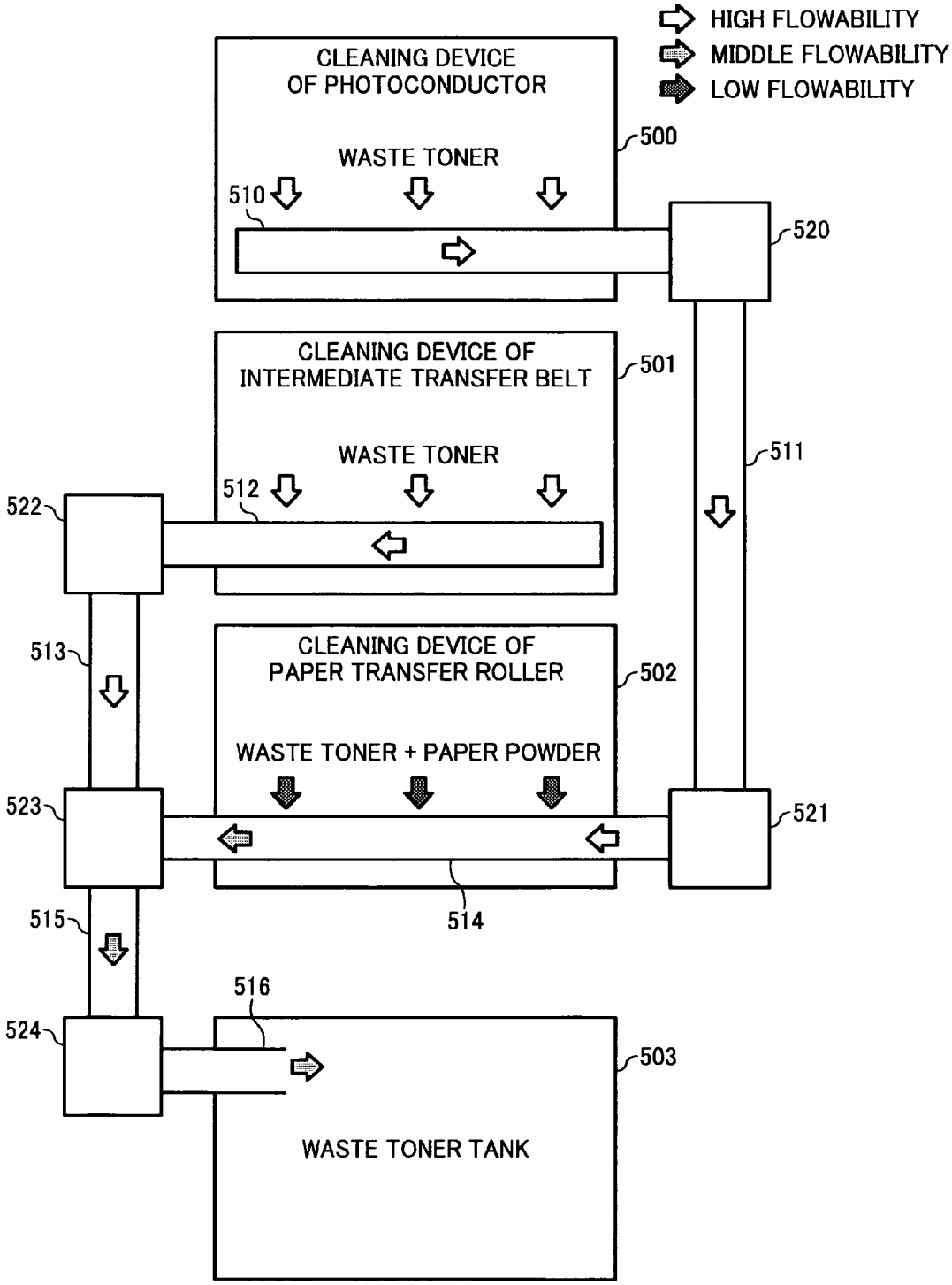
FIG. 4 is a schematic view illustrating flowabilities of waste toners and conveying directions for conveying the waste toner in waste toner conveying paths in a waste toner conveying device according to a second embodiment of the present invention.

FIG. 4 is a schematic view illustrating flowabilities of waste toners and conveying directions for conveying the waste toner in waste toner conveying and forwarding paths in the waste toner conveying device according to a second embodiment. In FIG. 4, reference numbers 510, 511, 512, 513, 514, 515 and 516 indicate paths configured to convey the waste toner, and each path may have a not-illustrated conveying member such as a conveying coil or an auger configured to rotate for flowing the waste toner in the directions indicated by the arrows. Reference numbers 520, 521, 522, and 524 indicate delivery parts configured to deliver the waste toner from one path to another path. The path of the waste toner is bent at a substantially-right angle at each delivery part. Reference number 523 indicates a T-shaped combined part where two paths are combined in a T-shaped form, that is, one path is linear and another path is bent at a substantially-right angle.

The photoconductor and intermediate-transfer waste toners having relatively-high flowability are stored in the photoconductor and intermediate-transfer cleaning devices 500, 501, and the paper-transfer waste toner having relatively-low flowability, which is mixed with paper powder, is stored in the paper-transfer cleaning device 502. The photoconductor, intermediate-transfer and paper-transfer waste toners fall into the first to third conveying paths 510, 512, 514 respectively.

The photoconductor waste toner having relatively-high flowability stored in the photoconductor cleaning device 500 is conveyed to the conveying path 510 and then the delivery part 520, turns at a substantially-right angle at the delivery part 520, passes through the forwarding path 511, turns at a substantially-right angle at the delivery part 521, and then is conveyed to the conveying path 514. In the conveying path 514, the photoconductor waste toner is mixed with the paper transfer waste toner having relatively-low flowability from the paper-transfer roller 57 and then the mixed waste toner having middle flowability passes through the combined part 523. The mixed waste toner turns at a substantially-right angle at the combined part 523, flows together with the intermediate-transfer waste toner, which is discharged from the intermediate-transfer cleaning device 501, and is conveyed to the delivery part 522, and to the forwarding path 513. The waste toners, mixed and flowing together with each other are finally conveyed to the waste toner tank 503 and stored therein.

In the above-described waste toner conveying device, the delivery parts 520, 521, 522, 524 are not clogged with the waste toner because the waste toner passing through the delivery parts 520, 521, 522, 524 has at least middle flowability even under the above-mentioned difficult condition. In addition, even at the combined part 523, each of the waste toners, which flow from two sides to the combined part 523, has high flowability, the combined part 523 is not clogged with the waste toners.

Figure 5:
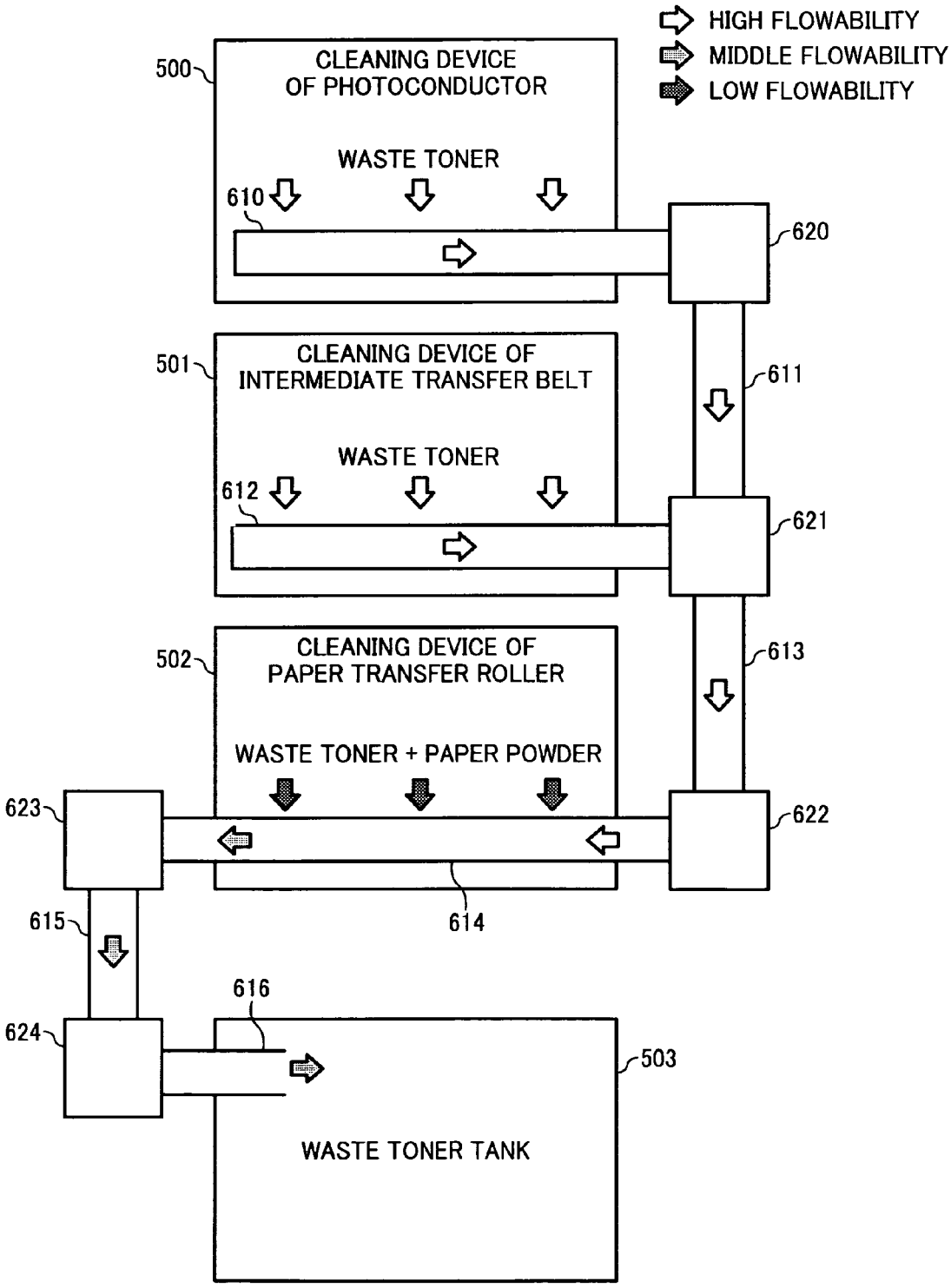
FIG. 5 is a schematic view illustrating flowabilities of waste toners and conveying directions for conveying the waste toner in waste toner conveying paths in a waste toner conveying device according to a third embodiment of the present invention.

As shown in FIG. 5, the at least one forwarding path may be configured to convey both of the first waste toner conveyed from the first cleaning device 500 through the first conveying path 610 and the third waste toner conveyed from the third cleaning device 501 through the third conveying path 612 to the waste toner storage device 503 via the second conveying path 614. The at least one forwarding path may include a first forwarding path 615 configured to convey the second waste toner conveyed from the second cleaning device 502 through the second conveying path 614 to the waste toner storage device 503, a second forwarding path 613 configured to convey the third waste toner conveyed from the third cleaning device 501 through the third conveying path 612 to the second conveying path 614, and a third forwarding path 611 configured to convey the first waste toner conveyed from the first cleaning device 500 through the first conveying path 610 to the second forwarding path 613.

FIG. 5 is a schematic view illustrating flowabilities of waste toners and conveying directions for conveying the waste toner in waste toner conveying and forwarding paths in the waste toner conveying device according to a third embodiment. In FIG. 5, reference numbers 610, 611, 612, 613, 614, 615 and 616 indicate paths configured to convey the waste toner, and each path may have a not-illustrated conveying member such as a conveying coil or an auger configured to rotate for flowing the waste toner in the directions indicated by the arrows. Reference numbers 620, 622, 623, and 624 indicate delivery parts configured to deliver the waste toner from one path to another path. The path of the waste toner is bent at a substantially-right angle at each delivery part. Reference number 621 indicates a T-shaped combined part where two paths are combined in a T-shaped form, that is, one path is linear and another path is bent at a substantially-right angle.

The photoconductor and intermediate-transfer waste toners having relatively-high flowability are stored in the photoconductor and intermediate-transfer cleaning devices 500, 501, and the paper-transfer waste toner having relatively-low flowability, which is mixed with paper powder, is stored in the paper-transfer cleaning device 502. The photoconductor, intermediate-transfer and paper-transfer waste toners fall into the first to third conveying paths 610, 612, 614 respectively.

The photoconductor waste toner having relatively-high flowability stored in the photoconductor cleaning device 500 is conveyed to the conveying path 610 and then the delivery part 620, turns at a substantially-right angle at the delivery part 620, passes through the forwarding path 611, and then is conveyed to the combined part 621. On the other hand, the intermediate-transfer waste toner having relatively-high flowability, that is, the flowability slightly less than the photoconductor waste toner but relatively high in the waste toner conveying device according to the third embodiment, stored in the intermediate-transfer cleaning device 501 passes through the conveying path 612, turns at a substantially-right angle at the combined part 621, and passes through the forwarding path 613 while flowing together with the photoconductor waste toner discharged from the photoconductor cleaning device 500. In the forwarding path 613, the flowability of the mixed waste toner is maintained relatively-high. The mixed waste toner turns at a substantially-right angle at the delivery part 622, and passes through the conveying path in the paper-transfer cleaning device 502. In the conveying path 614, the mixed waste toner is mixed with the paper-transfer waste toner having relatively-low flowability, which is from the paper transfer roller 57, and thereby the mixed waste toner having middle flowability is conveyed to the delivery part 623. The mixed toner having middle flowability turns at a substantially-right angle at the delivery part 623, passes through the forwarding path 615, the delivery part 624, the forwarding path 616 and is finally conveyed to the waste toner tank 503 and stored therein.

In the above-described waste toner conveying device, the delivery part 620, the combined part 621, the delivery parts 622, 623, 624 are not clogged with the waste toner because the waste toner passing therethrough has at least middle flowability even under the above-mentioned difficult condition.

The at least one forwarding path may be configured to convey the third waste toner conveyed from the third cleaning device 501 through the third conveying path to the waste toner storage device 503 via the second conveying path. The at least one forwarding path may include a first forwarding path configured to convey the second waste toner conveyed from the second cleaning device 502 through the second conveying path to the waste toner storage device 503, a second forwarding path configured to convey the first waste toner conveyed from the first cleaning device 500 through the first conveying path to the second conveying path, and a third forwarding path configured to convey the third waste toner conveyed from the third cleaning device 501 through the third conveying path to the second conveying path.

Figure 6:
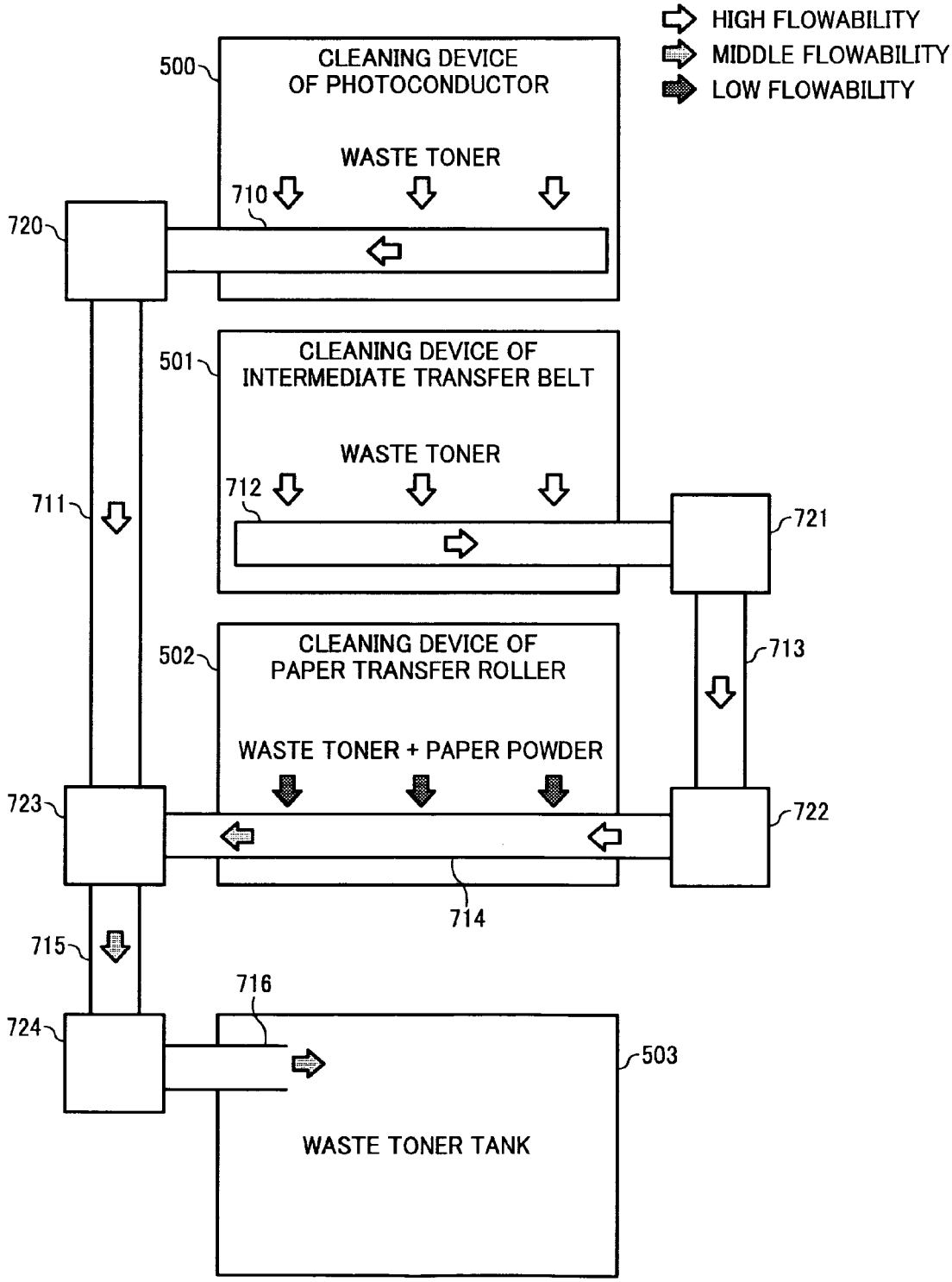
FIG. 6 is a schematic view illustrating flowabilities of waste toners and conveying directions for conveying the waste toner in waste toner conveying paths in a waste toner conveying device according to a fourth embodiment of the present invention.

FIG. 6 is a schematic view illustrating flowabilities of waste toners and conveying directions for conveying the waste toner in waste toner conveying and forwarding paths in the waste toner conveying device according to a fourth embodiment. In FIG. 6, reference numbers 710, 711, 712, 713, 714, 715 and 716 indicate paths configured to convey the waste toner, and each path may have a not-illustrated conveying member configured to rotate for flowing the waste toner in the directions indicated by the arrows. Reference numbers 720, 721, 722, and 724 indicate delivery parts configured to deliver the waste toner from one path to another path. The path of the waste toner is bent at a substantially-right angle at each delivery part. Reference number 723 indicates a T-shaped combined part where two paths are combined in a T-shaped form, that is, one path is linear and another path is bent at a substantially-right angle.

The photoconductor and intermediate-transfer waste toners having relatively-high flowability are stored in the photoconductor and intermediate-transfer cleaning devices 500, 501, and the paper-transfer waste toner having relatively-low flowability, which is mixed with paper powder, is stored in the paper-transfer cleaning device 502. The photoconductor, intermediate-transfer and paper-transfer waste toners fall into the first to third conveying paths 710, 712, 714 respectively.

The intermediate-transfer waste toner having relatively-high flowability stored in the intermediate-transfer cleaning device 501 is conveyed to the conveying path 712, turns at a substantially-right angle at the delivery part 721, passes through the forwarding path 713, turns at an angle at the delivery part 722 and then is conveyed to the conveying path 714 of the paper-transfer cleaning device 502. In the forwarding path 714, the intermediate-transfer waste toner is mixed with the paper-transfer waste toner having relatively-low flowability from the paper transfer roller 57 and the mixed waste toner having middle flowability is conveyed to the combined part 723. At the combined part 723, the mixed waste toner turns at a substantially-right angle at the combined part 723 and passes through the forwarding path 715 while flowing together with the waste toner discharged from the photoconductor cleaning device 500. The mixed waste toner passes through the delivery part 724, the forwarding path 716, and is finally conveyed to the waste toner tank 503 and stored therein.

In the above-described waste toner conveying device, the delivery part 720, 721, 722, and 724 are not clogged with the waste toner because the waste toner passing therethrough has at least middle flowability even under the above-mentioned difficult condition. Furthermore, the combined part 723 is not clogged with the waste toner even under the above-mentioned difficult circumstances because the waste toners flowing from the two sides have high flowability.

(Comparison Between the Second to Fourth Embodiments and Prior Arts 4 to 6)

Figure 12:
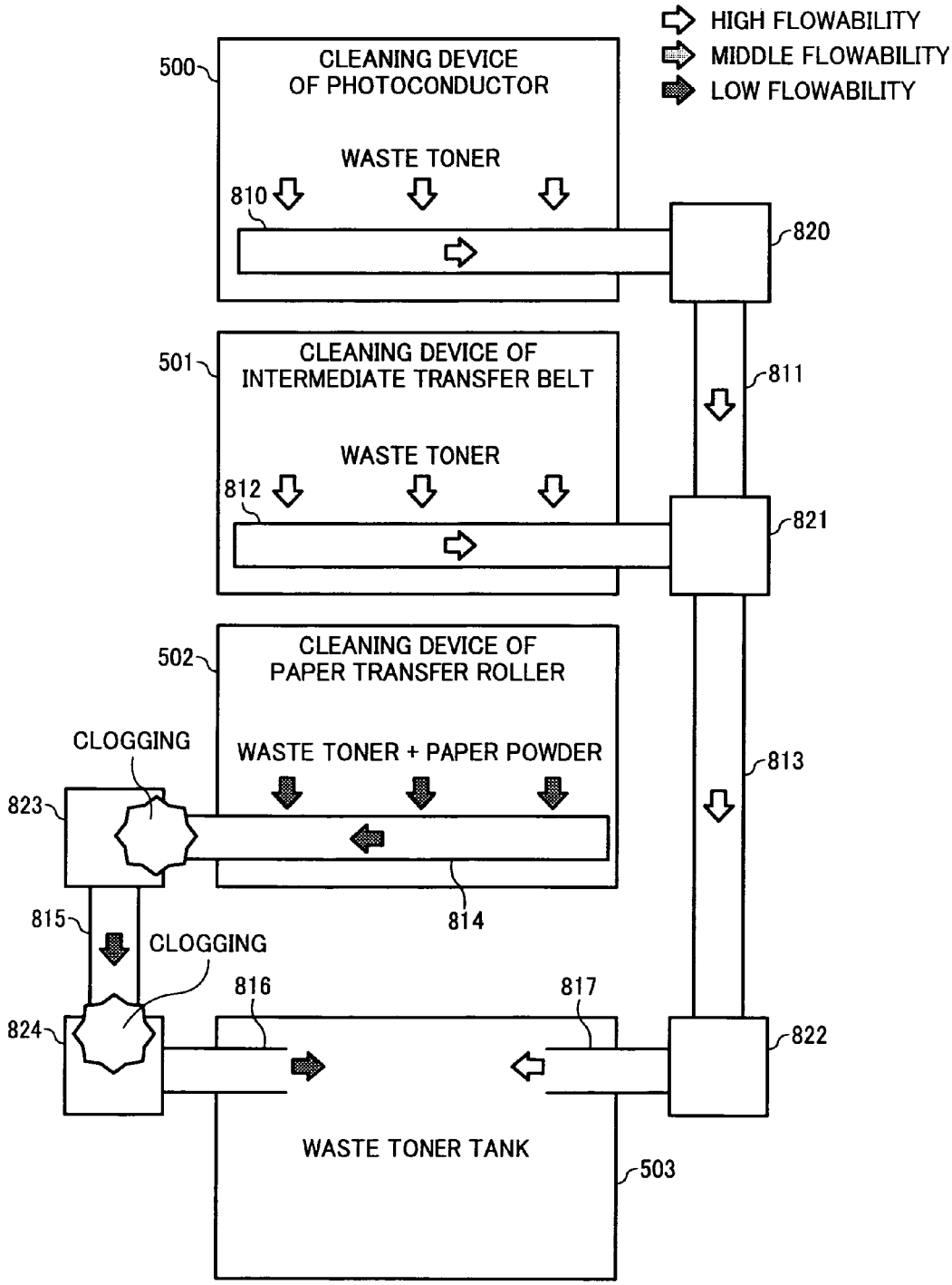
FIG. 12 is a schematic view illustrating flowabilities of waste toners and conveying directions for conveying the waste toner in waste toner conveying paths in a waste toner conveying device according to a fourth conventional example of the present invention.
Figure 13:
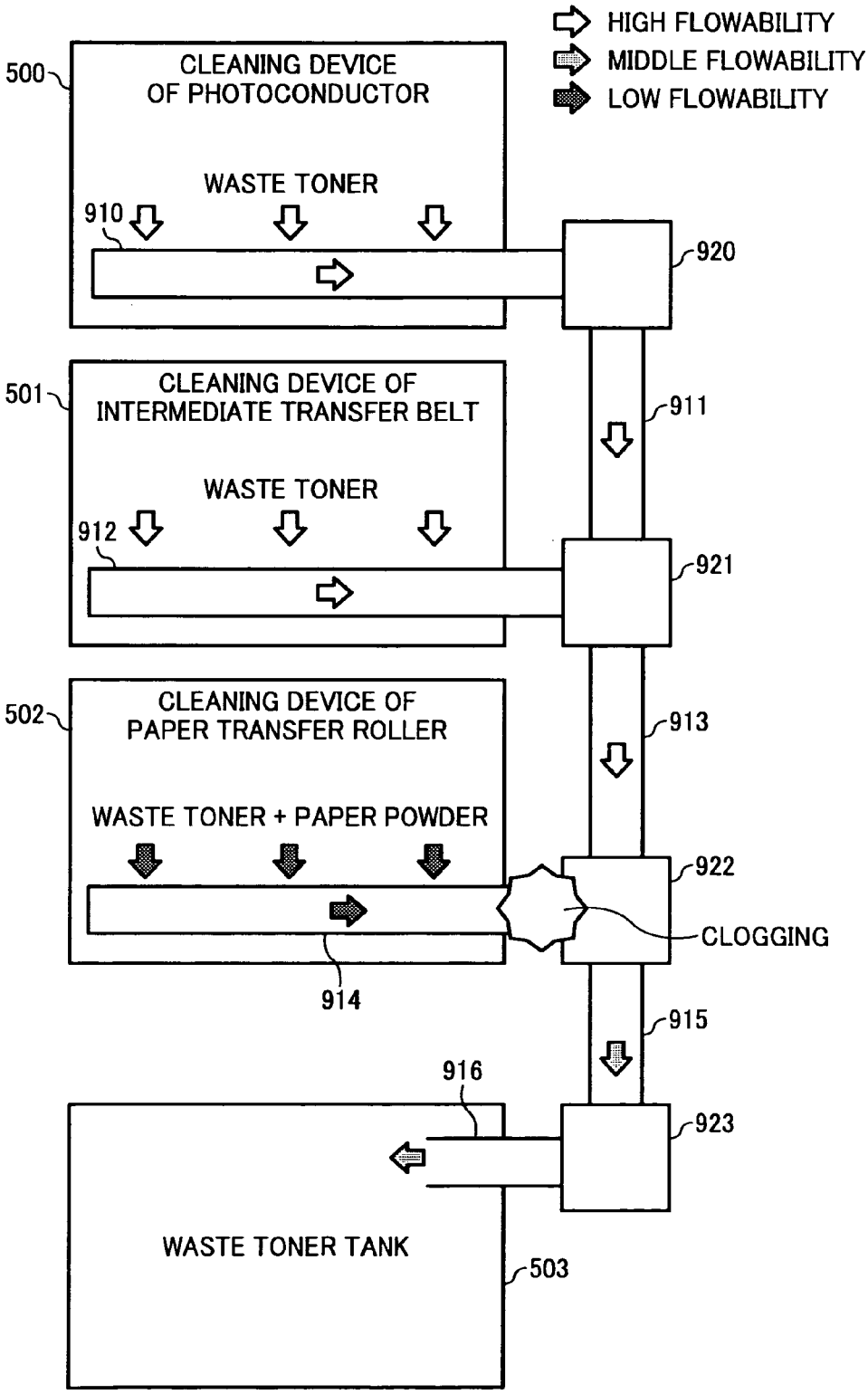
FIG. 13 is a schematic view illustrating flowabilities of waste toners and conveying directions for conveying the waste toner in waste toner conveying paths in a waste toner conveying device according to a fifth conventional example of the present invention.
Figure 14:
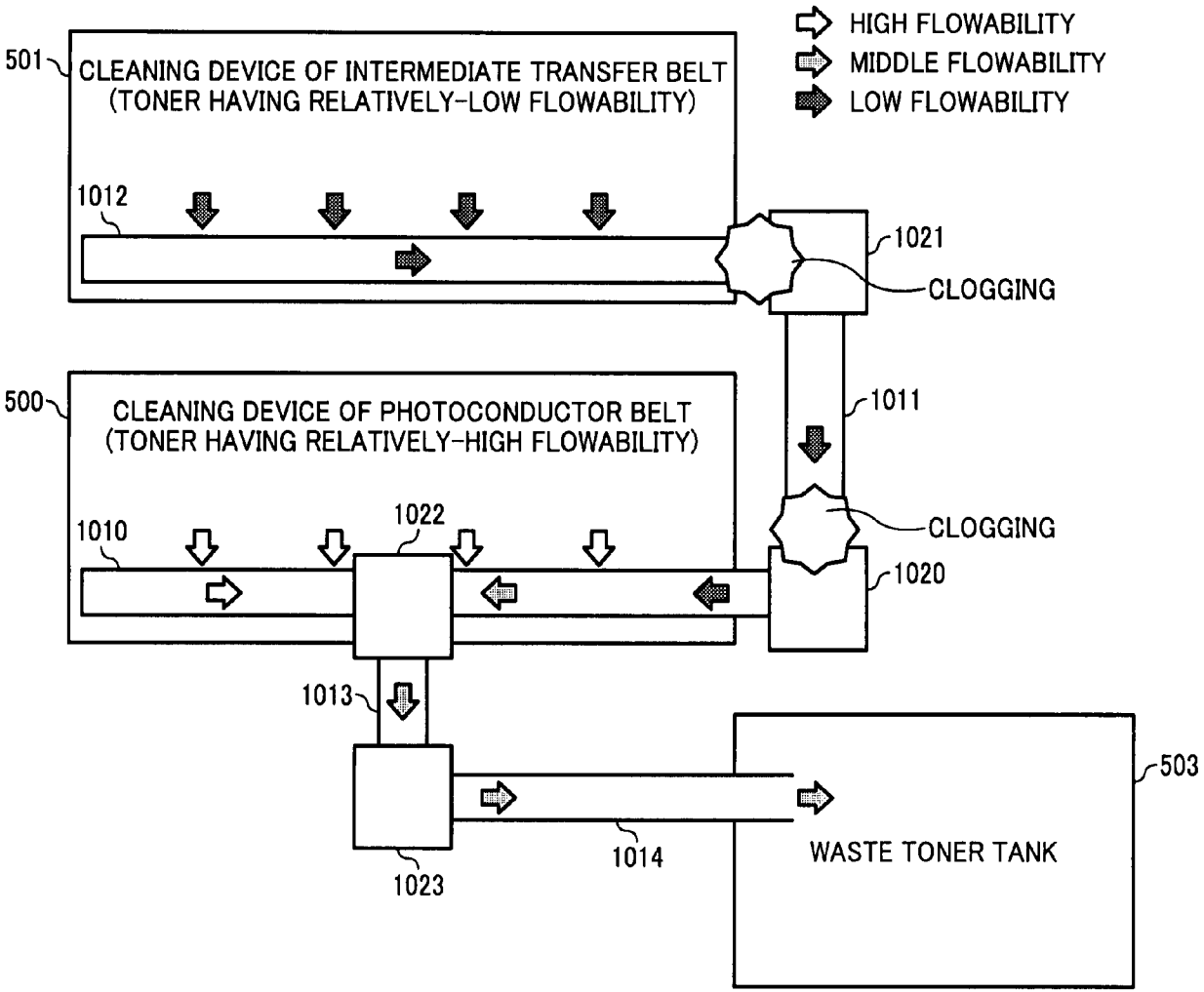
FIG. 14 is a schematic view illustrating flowabilities of waste toners and conveying directions for conveying the waste toner in waste toner conveying paths in a waste toner conveying device according to a sixth conventional example of the present invention.

The delivery parts 823, 824 in the prior art 4 (see FIG. 12), the combined part 922 in the prior art 5 (see FIG. 13), and the delivery parts 1020, 1021 in prior art 6 (see FIG. 14) are easily clogged with the waste toner under the above-mentioned difficult circumstances, because the waste toner having relatively-low flowability passes and passes and flows together with each other. On the other hand, in the second to fourth embodiments of the present invention, the waste toner having relatively low flowability is mixed with the waste toner having relatively high flowability before it passing through the combined part 523 (see FIG. 4), the delivery part 623 (see FIG. 5), and the combined part 723 (see FIG. 6) so that the waste toner has middle flowability and therefore the combined part 523, the delivery parts 623, and the combined part 723 are not clogged with the waste toner passing therethrough. Consequently, the waste toner conveying device of each of the second to fourth embodiments of the present invention has an advantageous configuration where the waste toner clogging can be more effectively prevented than the prior arts 4 to 6.

The waste toner conveying device according to an embodiment of the present invention may include at least one first conveying path configured to convey first waste toner having paper powder at a low mixed ratio, which is stored in a first cleaning device, outside the first cleaning device, at least one second conveying path configured to convey second waste toner having a paper powder at a high mixed ration, which is stored in a second cleaning device, outside the second cleaning device, at least one third conveying path configured to convey third waste toner having paper powder at a mixed ratio which is equal to or more than the first waste toner and less than the second waste toner, which is stored in a third cleaning device, outside the third cleaning device, at least one fourth conveying path configured to convey fourth waste toner having paper powder at a mixed ratio which is equal to or more than the first waste toner and less than the second waste toner, which is stored in a fourth cleaning device, outside the fourth cleaning device, and at least one forwarding path configured to convey the first waste toner conveyed from the first cleaning device through the at least one first conveying path, the second waste toner conveyed from the second cleaning device through the at least one second conveying path, the third waste toner conveyed from the third cleaning device through the at least one third conveying path, and the fourth waste toner conveyed from the fourth cleaning device through the at least one fourth conveying path to a waste toner storage device. The at least one forwarding path may be configured to convey the first waste toner conveyed from the first cleaning device through the at least one first conveying path to the waste toner storage device via the at least one second conveying path.

Figure 7:
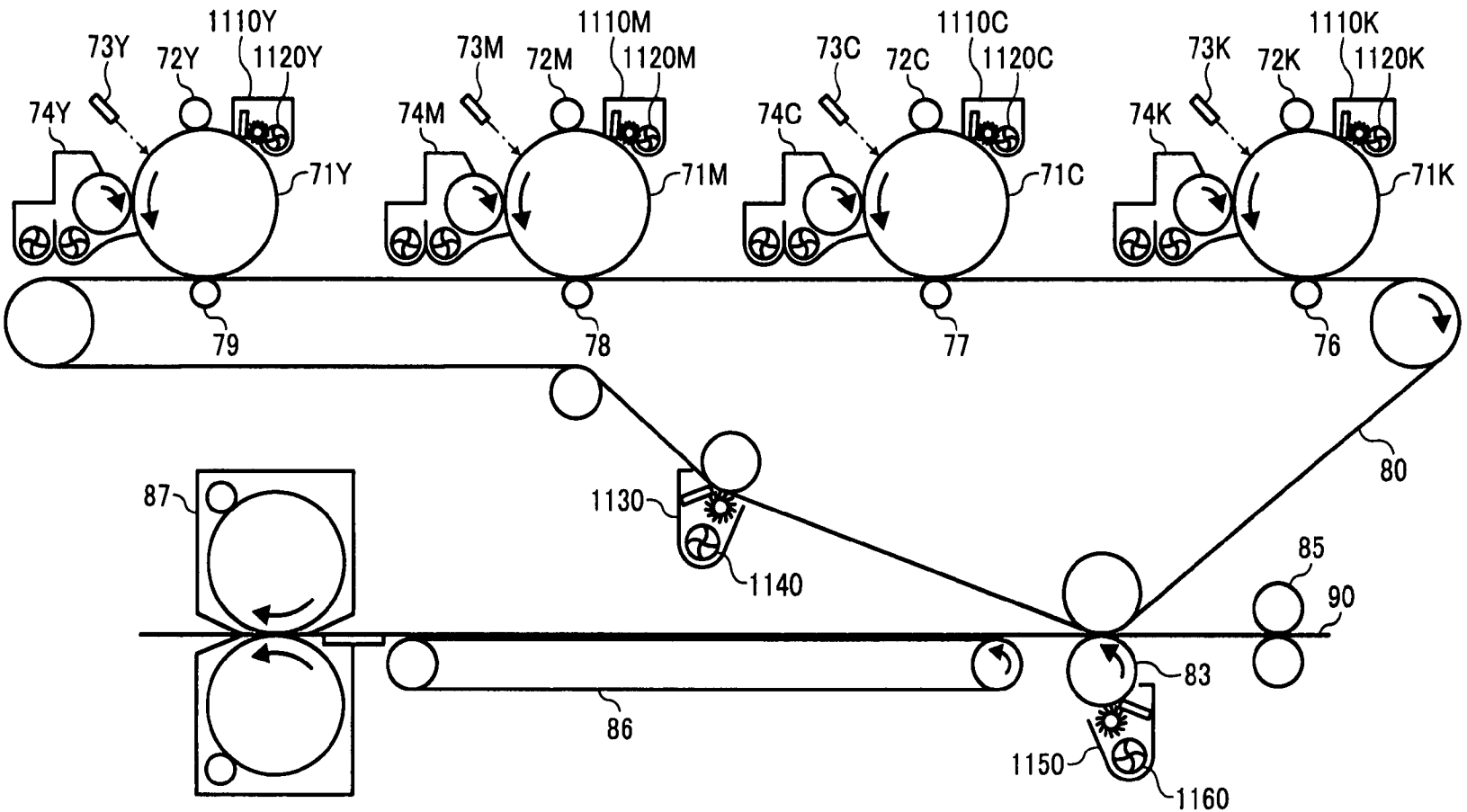
FIG. 7 is an explanatory view illustrating a layout of an image forming part of an image forming apparatus according to another embodiment of the present invention.

FIG. 7 is an explanatory view illustrating a layout of an image forming part of another embodiment of the present invention. The configurations are explained hereinbefore and therefore the same reference numbers are used for the same configurations and explanation thereof is omitted.

The waste toner conveying device according to an embodiment of the present invention, may include only one first conveying path and two or more fourth conveying paths.

The at least one forwarding path may include a first forwarding path configured to convey the first waste toner conveyed from the first cleaning device through the first conveying path to the waste toner storage device, a second forwarding path configured to convey the second waste toner conveyed from the second cleaning device through the second conveying path to the waste toner storage device, a third forwarding path configured to convey the third waste toner conveyed from the third cleaning device through the third conveying path to the waste toner storage device, a fourth forwarding path configured to convey the fourth waste toner conveyed from the fourth cleaning device through the fourth conveying path to the third forwarding conveying path.

The first waste toner stored in the first cleaning device may be set at a temperature lower than the second to fourth waste toners stored in the second to fourth cleaning device, respectively. The first waste toner set at the temperature may be conveyed to the waste toner storage device via the second conveying path.

The first cleaning device may be configured to remove the first waste toner from a photoconductor for a black toner, the second cleaning device is configured to remove the second waste toner from a paper transfer roller, the third cleaning device is configured to remove the third waste toner from an intermediate transfer body, and the fourth cleaning device is configured to remove the fourth waste toner from a photoconductor for each of yellow toner, magenta toner, and cyan toner.

The at least one forwarding path may be configured to convey the first waste toner conveyed from the first cleaning device through the first conveying path, the third waste toner conveyed from the third cleaning device through the third conveying path, and the fourth waste toner conveyed from the fourth cleaning device through the fourth conveying path to the waste toner storage device via the second conveying path.

Figure 8:
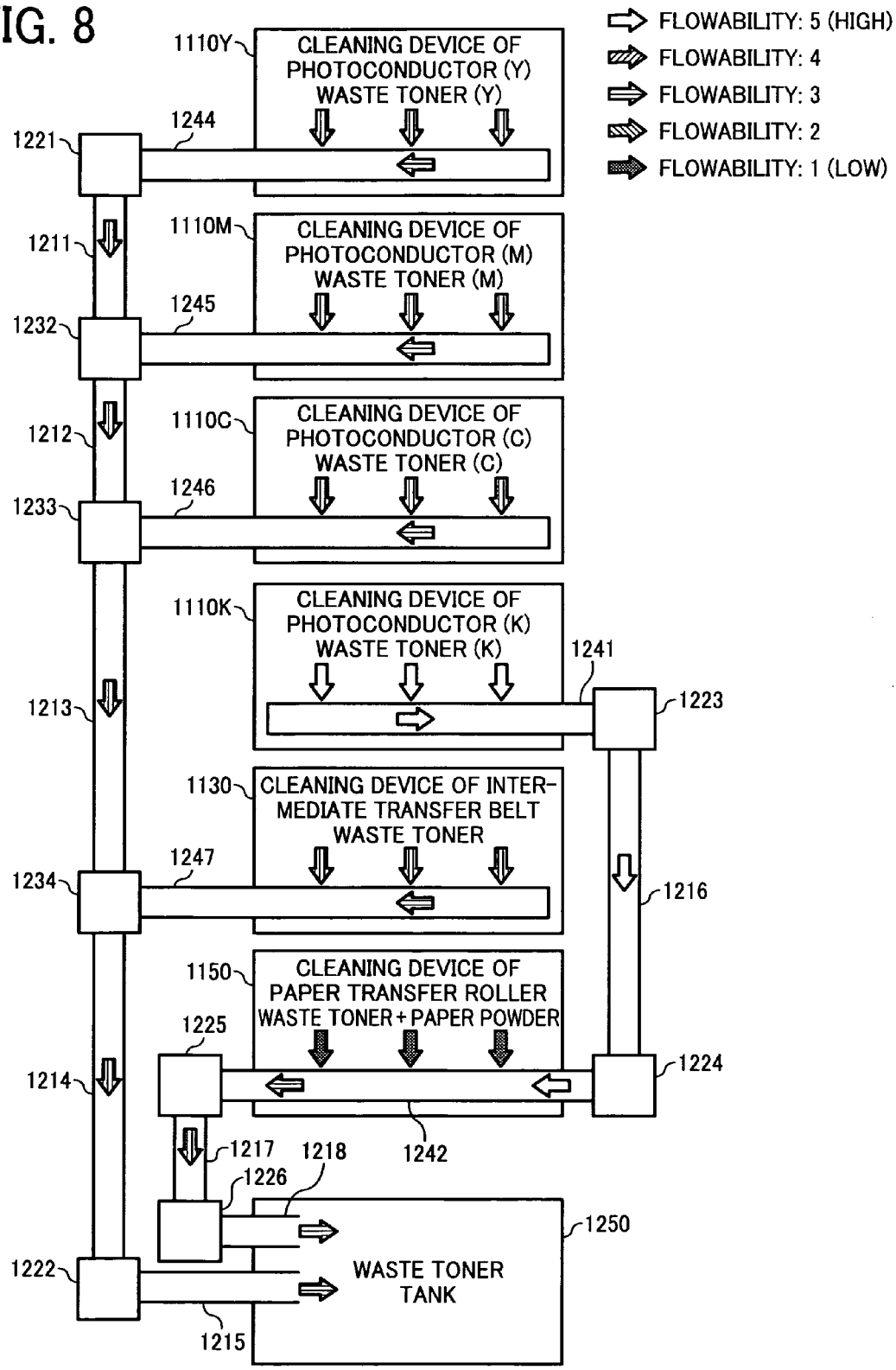
FIG. 8 is a schematic view illustrating flowabilities of waste toners and conveying directions for conveying the waste toner in waste toner conveying paths in a waste toner conveying device according to a fifth embodiment of the present invention.

FIG. 8 is a schematic view illustrating flowabilities of waste toners and conveying directions for conveying the waste toner in waste toner conveying and forwarding paths in the waste toner conveying device according to a fifth embodiment. In FIG. 8, reference numbers 1211, 1212, 1213, 1214, 1215, 1216, 1217, 1218, 1244, 1245, 1246, 1247 and 1242 indicate paths configured to convey the waste toner, and each path may have a not-illustrated conveying member such as a conveying coil or an auger configured to rotate for flowing the waste toner in the directions indicated by the arrows. Reference numbers 1221, 1222, 1223, 1224, 1225 and 1226 indicate delivery parts configured to deliver the waste toner from one path to another path. The path of the waste toner is bent at a substantially-right angle at each delivery part. Each of reference numbers 1232, 1233 and 1234 indicates a T-shaped combined part where two paths are combined in a T-shaped form, that is, one path is linear and another path is bent at a substantially-right angle.

The photoconductor waste toner having high flowability (level 5) is stored in the photoconductor cleaning device 110K, and the photoconductor waste toners and the intermediate-transfer waste toner each having middle flowability (level 3) are stored in the photoconductor cleaning devices 1110Y, 1110M, 1110C, and the intermediate-transfer cleaning device 1130, respectively. The paper-transfer waste toner having low flowability (level 1) is stored in the paper-transfer cleaning device 1150.

The photoconductor waste toner having relatively-high flowability stored in the photoconductor cleaning device 1110K passes through the conveying path 1241, the delivery part 1223, the forwarding path 1216, the delivery part 1224, and then is conveyed to the conveying path 1242 in the paper-transfer cleaning device 1150. In the conveying path 1242, the photoconductor waste toner is mixed with the waste toner having relatively-low flowability (level 1) from the paper-transfer cleaning device 1150 and the mixed waste toner having middle flowability (level 3) is conveyed to the delivery part 1225. The mixed waste toner passes through the delivery part 1225, the forwarding path 1217, the delivery part 1226, the forwarding path 1218, and is finally conveyed to the waste toner tank 1250 and stored therein.

On the other hand, the photoconductor waste toners and the intermediate-transfer waste toner stored in the photoconductor cleaning devices 1110Y, 1110M, 1110C and the intermediate-transfer cleaning device 1130, respectively, pass through the conveying path 1244, 1245, 1246, 1247 and the delivery parts 1221, 1222, and the combined parts 1232, 1233, 1234, are conveyed to the waste toner tank 1250 and stored therein.

In the above-described waste toner conveying device according to the fifth embodiment, the delivery parts 1221, 1222, 1223, 1224, 1225, 1226 and the combined parts 1232, 1233, 1234 are not clogged with the waste toner because the waste toner passing therethrough has at least middle flowability (level 3) even under the difficult condition, for example, in continuous working at a high temperature.

(Comparison Between the Fifth Embodiment and Prior Art 7)

The delivery parts 1325, 1326 in the prior art 7 (see FIG. 15), are easily clogged with the waste toner under the above-mentioned difficult circumstances, more particularly, in continuous working at a high temperature, because the waste toner having relatively-low flowability passes and passes and flows together with each other. On the other hand, in the fifth embodiment of the present invention, the waste toner having relatively low flowability is mixed with the waste toner having relatively high flowability before it passing through the delivery parts 1225, 1226 (see FIG. 8), so that the waste toner has middle flowability and therefore the delivery parts 1225, 1226 are not clogged with the waste toner passing therethrough. That is, the waste toner conveying device of the fifth embodiment of the present invention has an advantageous configuration where the waste toner clogging can be more effectively prevented than the prior art 7.

In the fifth embodiment, waste toner discharged from an outlet port of the conveying path of the photoconductor cleaning device 1110K, which is at a temperature lower than outlet ports of the conveying paths of the other cleaning devices is conveyed to the waste toner tank 1250 via the paper-transfer cleaning device. That is, in continuous working at the high temperature, generally, the outlet port of the conveying path 1241 of the photoconductor cleaning device 1110K is at 46° C., the outlet ports of the conveying paths 1245, 1246 of the photoconductor cleaning devices 1110M, 1110C are at 50° C., and the outlet port of the conveying path 1244 of the photoconductor cleaning device 1110Y is at 51° C., the outlet port of the conveying path 1247 of the intermediate-transfer cleaning device 1130 is at 51° C., and the outlet port of the conveying path 1242 of the paper-transfer cleaning device 1150 is at 46 to 52° C.

Under the above-described conditions of the temperatures at the outlet ports of the conveying paths, the waste toner of the conveying path 1241 of the photoconductor cleaning device 1110K, which is at a temperature lower than the waste toners of the conveying paths of the other cleaning devices 1110Y, 1110M, 1110C, 1130, 1150 is conveyed to the waste toner tank 1250 via the conveying path 1242 of the paper-transfer cleaning device 1150. Because the low-temperature waste toner is conveyed via the conveying path 1242, the waste toner having relatively-low flowability is mixed with the waste toner having relatively-high flowability before it passes through the delivery parts 1225, 1226 and the mixed waste toner has middle flowability as described above. Accordingly, the delivery parts 1225, 1226 are not clogged with the mixed waste toner when passing therethrough.

In the above embodiment, although the temperature of the outlet port of the conveying path of each cleaning device is explained, a temperature of other part of the one cleaning device, for example, a cleaning blade, or a temperature of waste toner itself in the one cleaning device may be compared with the others and the waste toner at the temperature lower than the others may be conveyed via the paper-transfer cleaning device to the waste toner tank. In this case, the waste toner conveying device of the present invention has an advantageous configuration where the waste toner clogging can be more effectively prevented than the prior art where the waste toner of one cleaning device at the temperature relatively-higher than the other cleaning devices is conveyed via the paper-transfer cleaning device.

Although the present invention has been described in terms of exemplary embodiments, it is not limited thereto. It should be appreciated that variations may be made in the embodiments described by persons skilled in the art without departing from the scope of the present invention as defined by the following claims.

According to an embodiment of the present invention, a waste toner conveying device and an image forming apparatus where the waste toner clogging can be more effectively prevented than prior art where the waste toner clogging easily occurs when the paper powder is included in the waste toner at high mixed ratio can be provided.

What is claimed is:

1. A waste toner conveying device, comprising:

a first conveying path configured to convey waste toner having paper powder at a low mixed ratio, which is stored in a first cleaning device, outside the first cleaning device;

a second conveying path configured to convey second waste toner having a paper powder at a high mixed ration, which is stored in a second cleaning device, outside the second cleaning device; and at least one forwarding path configured to convey the first waste toner conveyed from the first cleaning device through the first conveying path and the second waste toner conveyed from the second cleaning device through the second conveying path are conveyed to a waste toner storage device, wherein the at least one forwarding path is configured to convey the first waste toner conveyed from the first cleaning device through the first conveying path to the waste toner storage device via the second conveying path.

2. The waste toner conveying device according to claim 1, wherein the at least one forwarding path includes a first forwarding path configured to convey the first waste toner conveyed from the first cleaning device through the first conveying path to the second conveying path and a second forwarding path configured to convey the first and second waste toner conveyed from the second cleaning device through the second conveying path to the waste toner storage device.

3. The waste toner conveying device according to claim 1, wherein the first cleaning device is configured to remove the first waste toner from a photoconductor and the second cleaning device is configured to remove the second waste toner from a paper transfer roller.

4. The waste toner conveying device according to claim 1, further comprising:

a third conveying path configured to convey third waste toner having paper powder at a mixed ratio which is equal to or more than the first waste toner and less than the second waste toner, which is stored in a third cleaning device, outside the third cleaning device, wherein the third waste toner conveyed from the third cleaning device through the third conveying path is conveyed through the forwarding path to the waste toner storage device; and the at least one forwarding path is configured to flow the third waste toner conveyed from the third cleaning device through the third conveying path into the first and second waste toners conveyed via the second conveying path.

5. The waste conveying device according to claim 4, wherein the at least one forwarding path includes a first forwarding path configured to convey the first waste toner conveyed from the first cleaning device through the first conveying path to the second conveying path, a second forwarding path configured to convey the second waste toner conveyed from the second cleaning device through the second conveying path to the waste toner storage device, and a third forwarding path configured to convey the third waste toner conveyed from the third cleaning device through the third conveying path to the second forwarding path.

6. The waste toner conveying device according to claim 1, further comprising:

a third conveying path configured to convey third waste toner having paper powder at a mixed ratio which is equal to or more than the first waste toner and less than the second waste toner, which is stored in a third cleaning device, outside the third cleaning device, wherein the third waste toner conveyed from the third cleaning device through the third conveying path is conveyed through the forwarding path to the waste toner storage device; and the at least one forwarding path is configured to convey both of the first waste toner conveyed from the first cleaning device through the first conveying path and the third waste toner conveyed from the third cleaning device through the third conveying path to the waste toner storage device via the second conveying path.

7. The waste toner conveying device according to claim 6, wherein the at least one forwarding path includes a first forwarding path configured to convey the second waste toner conveyed from the second cleaning device through the second conveying path to the waste toner storage device, a second forwarding path configured to convey the third waste toner conveyed from the third cleaning device through the third conveying path to the second conveying path, and a third forwarding path configured to convey the first waste toner conveyed from the first cleaning device through the first conveying path to the second forwarding path.

8. The waste toner conveying device according to claim 4, wherein the first cleaning device is configured to remove the first waste toner from a photoconductor, the second cleaning device is configured to remove the second waste toner from a paper transfer roller, and the third cleaning device is configured to remove the third waste toner from an intermediate transfer body.

9. An image forming apparatus comprising the waste toner conveying device according to claim 4.

10. An image forming apparatus comprising the waste toner conveying device according to claim 1.

11. A waste toner conveying device, comprising:

a first conveying path configured to convey first waste toner having paper powder at a low mixed ratio, which is stored in a first cleaning device, outside the first cleaning device;

a second conveying path configured to convey second waste toner having a paper powder at a high mixed ration, which is stored in a second cleaning device, outside the second cleaning device;

a third conveying path configured to convey third waste toner having paper powder at a mixed ratio which is equal to or more than the first waste toner and less than the second waste toner, which is stored in a third cleaning device, outside the third cleaning device; and at least one forwarding path configured to convey the first waste toner conveyed from the first cleaning device through the first conveying path, the second waste toner conveyed from the second cleaning device through the second conveying path, and the third waste toner conveyed from the third cleaning device through the third conveying path to a waste toner storage device, wherein the at least one forwarding path is configured to convey the third waste toner conveyed from the third cleaning device through the third conveying path to the waste toner storage device via the second conveying path.

12. The waste toner conveying device according to claim 11, wherein the at least one forwarding path includes a first forwarding path configured to convey the second waste toner conveyed from the second cleaning device through the second conveying path to the waste toner storage device, a second forwarding path configured to convey the first waste toner conveyed from the first cleaning device through the first conveying path to the second conveying path, and a third forwarding path configured to convey the third waste toner conveyed from the third cleaning device through the third conveying path to the second conveying path.

13. A waste toner conveying device, comprising:

at least one first conveying path configured to convey first waste toner having paper powder at a low mixed ratio, which is stored in a first cleaning device, outside the first cleaning device;

at least one second conveying path configured to convey second waste toner having a paper powder at a high mixed ration, which is stored in a second cleaning device, outside the second cleaning device;

at least one third conveying path configured to convey third waste toner having paper powder at a mixed ratio which is equal to or more than the first waste toner and less than the second waste toner, which is stored in a third cleaning device, outside the third cleaning device;

at least one fourth conveying path configured to convey fourth waste toner having paper powder at a mixed ratio which is equal to or more than the first waste toner and less than the second waste toner, which is stored in a fourth cleaning device, outside the fourth cleaning device; and at least one forwarding path configured to convey the first waste toner conveyed from the first cleaning device through the at least one first conveying path, the second waste toner conveyed from the second cleaning device through the at least one second conveying path, the third waste toner conveyed from the third cleaning device through the at least one third conveying path, and the fourth waste toner conveyed from the fourth cleaning device through the at least one fourth conveying path to a waste toner storage device, wherein the at least one forwarding path is configured to convey the first waste toner conveyed from the first cleaning device through the at least one first conveying path to the waste toner storage device via the at least one second conveying path.

14. The waste toner conveying device according to claim 13, comprising only one first conveying path and two or more fourth conveying paths.

15. The waste toner conveying device according to claim 13, wherein the at least one forwarding path includes a first forwarding path configured to convey the first waste toner conveyed from the first cleaning device through the first conveying path to the waste toner storage device, a second forwarding path configured to convey the second waste toner conveyed from the second cleaning device through the second conveying path to the waste toner storage device, a third forwarding path configured to convey the third waste toner conveyed from the third cleaning device through the third conveying path to the waste toner storage device, a fourth forwarding path configured to convey the fourth waste toner conveyed from the fourth cleaning device through the fourth conveying path to the third forwarding conveying path.

16. The waste toner conveying device according to claim 13, wherein the first waste toner stored in the first cleaning device is set at a temperature lower than the second to fourth waste toners stored in the second to fourth cleaning device, respectively; and the first waste toner set at the temperature is conveyed to the waste toner storage device via the second conveying path.

17. The waste toner conveying device according to claim 13, wherein the first cleaning device is configured to remove the first waste toner from a photoconductor for a black toner, the second cleaning device is configured to remove the second waste toner from a paper transfer roller, the third cleaning device is configured to remove the third waste toner from an intermediate transfer body, and the fourth cleaning device is configured to remove the fourth waste toner from a photoconductor for each of yellow toner, magenta toner, and cyan toner.

18. The waste toner conveying device according to claim 13, wherein the at least one forwarding path is configured to convey the first waste toner conveyed from the first cleaning device through the first conveying path, the third waste toner conveyed from the third cleaning device through the third conveying path, and the fourth waste toner conveyed from the fourth cleaning device through the fourth conveying path to the waste toner storage device via the second conveying path.

19. An image forming apparatus comprising the waste toner conveying device according to claim 13.

* * * * *